US010119759B2

(12) United States Patent
Watanabe

(10) Patent No.: US 10,119,759 B2
(45) Date of Patent: Nov. 6, 2018

(54) HEAT RADIATING APPARATUS AND LIGHT ILLUMINATING APPARATUS WITH THE SAME

(71) Applicant: HOYA CANDEO OPTRONICS CORPORATION, Toda-shi, Saitama (JP)

(72) Inventor: Hiroaki Watanabe, Toda (JP)

(73) Assignee: HOYA CANDEO OPTRONICS CORPORATION, Toda-Shi, Saitama (JP)

( * ) Notice: Subject to any disclaimer, the term of this patent is extended or adjusted under 35 U.S.C. 154(b) by 0 days.

(21) Appl. No.: 15/464,771

(22) Filed: Mar. 21, 2017

(65) Prior Publication Data

US 2017/0284738 A1 Oct. 5, 2017

(30) Foreign Application Priority Data

Mar. 31, 2016 (JP) ..... 2016-073749
Feb. 14, 2017 (JP) ..... 2017-025339

(51) Int. Cl.

| | |
|---|---|
| ***F21V 29/503*** | (2015.01) |
| ***F21V 29/502*** | (2015.01) |
| ***F28D 15/02*** | (2006.01) |
| ***F26B 3/28*** | (2006.01) |
| ***F26B 3/26*** | (2006.01) |

(Continued)

(52) U.S. Cl.

CPC ..... *F26B 3/28* (2013.01); *B41F 23/0453* (2013.01); *F21V 29/503* (2015.01); *F21V 29/51* (2015.01);

(Continued)

(58) Field of Classification Search

CPC ..... H01L 2924/0002; H01L 2924/00; H01L 2924/00014; H01L 23/427; H01L 23/467;

(Continued)

(56) References Cited

U.S. PATENT DOCUMENTS 6,469,894 B2 * 10/2002 Ubukata ..... H01L 23/4006 165/104.33
6,945,319 B1 * 9/2005 Li ..... F28D 15/0275 165/104.33

(Continued)

FOREIGN PATENT DOCUMENTS

CN 1719181 A 1/2006
CN 201652263 U 11/2010

(Continued)

OTHER PUBLICATIONS

Database WPI Section PQ, Week 201558 Thomson Scientific, London, GB; Class P74, An 2015-482156 XP002772759, -& JP 2015153771A (Kyocera Corp) (previously submitted).

(Continued)

*Primary Examiner* — David A Vanore
(74) *Attorney, Agent, or Firm* — Rabin & Berdo, P.C.

(57) ABSTRACT

Provided is a heat radiating apparatus. The heat radiating apparatus includes a support member in close contact with the heat source, a heat pipe thermally joined with the support member, and a plurality of heat radiating fins placed in a space that faces a second principal surface. The heat pipe includes a first line part thermally joined with the support member, a second line part thermally joined with the heat radiating fins, and a connecting part which connects the first line part to the second line part. A length of the heat pipe is slightly shorter than or equal to the support member. The connecting part has a curved part thermally joined with the support member. When a plurality of heat radiating apparatuses are arranged in the direction in which the first line part extends, the heat radiating apparatuses can be connected such that the first principal surfaces are successive.

20 Claims, 19 Drawing Sheets

(51) Int. Cl.

| | |
|---|---|
| ***F21V 29/51*** | (2015.01) |
| ***F21V 29/67*** | (2015.01) |
| ***F21V 29/71*** | (2015.01) |
| ***F21V 29/76*** | (2015.01) |
| ***F28F 1/32*** | (2006.01) |
| ***F28F 9/013*** | (2006.01) |
| ***B41F 23/04*** | (2006.01) |
| *F21Y 105/16* | (2016.01) |
| *F21Y 115/10* | (2016.01) |

(52) U.S. Cl.
CPC ..... *F21V 29/673* (2015.01); *F21V 29/713* (2015.01); *F21V 29/763* (2015.01); *F26B 3/26* (2013.01); *F28D 15/0275* (2013.01); *F28F 1/325* (2013.01); *F28F 9/0131* (2013.01); *F21Y 2105/16* (2016.08); *F21Y 2115/10* (2016.08); *F28F 2210/10* (2013.01)

(58) Field of Classification Search
CPC ..... H01L 23/367; H01L 23/4006; H01L 21/4882; H01L 2224/16225; H01L 2224/73253; F28D 15/0275; F28D 15/0233; F28D 15/02; F28D 15/0266; F28D 2021/0029; F28D 2021/0031; F28F 1/32; F28F 1/12; F28F 1/24; F28F 1/02; F28F 1/04; F28F 1/14; F28F 1/20; F28F 1/30; F28F 21/084; F28F 21/085; F28F 2215/10; F28F 2250/08; F28F 2275/085; F28F 2275/10; F28F 3/02; F21V 29/51; F21V 29/67; F21V 29/673; F21V 29/767; F21V 29/004
USPC ... 165/104.21, 104.33, 80.3, 185, 80.2, 151, 165/181, 67; 361/700, 697, 703, 704, 361/709, 719, 679.47, 679.52, 679.54, 361/701, 710; 257/E23.088, E23.102, 88; 174/15.2, 16.3; 313/46
See application file for complete search history.

(56) References Cited

U.S. PATENT DOCUMENTS

| | | | | |
|---|---|---|---|---|
| 7,025,125 | B2 * | 4/2006 | Sheng | F28D 15/0233 165/104.21 |
| 7,028,758 | B2 * | 4/2006 | Sheng | F28D 15/0275 165/104.21 |
| 7,165,603 | B2 * | 1/2007 | Mochizuki | F28D 15/02 165/104.21 |
| 7,304,847 | B2 * | 12/2007 | Hwang | F28F 1/30 165/104.33 |
| 7,545,646 | B2 * | 6/2009 | Holmberg | F28D 15/0266 165/80.2 |
| 7,983,043 | B2 * | 7/2011 | Xu | F28D 15/0233 165/185 |
| 8,330,337 | B2 * | 12/2012 | Yu | F21V 29/004 165/104.26 |
| 9,109,784 | B2 * | 8/2015 | Lee | F21V 29/767 |
| 9,841,172 | B2 * | 12/2017 | Watanabe | F21V 23/005 |
| 9,894,803 | B1 * | 2/2018 | Artis | H05K 7/20336 |
| 2004/0035558 | A1 * | 2/2004 | Todd | F28D 15/0275 165/104.26 |
| 2004/0135159 | A1 * | 7/2004 | Siegel | B41F 23/0409 257/88 |
| 2005/0092465 | A1 * | 5/2005 | Lin | F28D 15/0275 165/104.21 |
| 2007/0217153 | A1 | 9/2007 | Lai et al. | |
| 2009/0084529 | A1 * | 4/2009 | Huang | F28D 15/0275 165/104.33 |
| 2011/0100604 | A1 * | 5/2011 | Anzai | B21D 53/08 165/104.21 |
| 2012/0098401 | A1 * | 4/2012 | Yu | F21V 29/004 313/46 |
| 2016/0348887 | A1 * | 12/2016 | Kobayashi | B41J 11/002 |
| 2017/0197001 | A1 * | 7/2017 | Shito | A61L 2/10 |
| 2017/0284650 | A1 * | 10/2017 | Watanabe | F21V 29/713 |

FOREIGN PATENT DOCUMENTS

| | | | |
|---|---|---|---|
| DE | 202016100007 | U1 | 1/2016 |
| EP | 2436967 | A1 | 4/2012 |
| JP | 2014-038866 | A | 2/2014 |
| JP | 2015-153771 | A | 8/2015 |

OTHER PUBLICATIONS

Database WPI Section PQ, Week 200642 Thomson Scientific, London, GB; Class Q78, An 2006-403642 XP002772760, -& CN 1719181A (Suzhou Jinmei Furniture Co Ltd).
Foreign Office Action dated Jul. 27, 2018, with an English translation.

* cited by examiner

HEAT RADIATING APPARATUS AND LIGHT ILLUMINATING APPARATUS WITH THE SAME

TECHNICAL FIELD

The present disclosure relates to a heat radiating apparatus for cooling a light source of a light illuminating apparatus, and more particularly, to a heat pipe-type heat radiating apparatus with heat pipe that is inserted into and passes through a plurality of heat radiating fins, and a light illuminating apparatus with the heat radiating apparatus.

BACKGROUND ART

Conventionally, an ultraviolet (UV) curable ink that is cured by radiation of UV light is used as an ink for sheet-fed offset printing. Furthermore, a UV curable resin is used as an adhesive around Flat Panel Display (FPD) such as a liquid crystal panel or an organic Electro Luminescence (EL) panel. To cure the UV curable ink or UV curable resin, generally, a UV light illuminating apparatus that irradiates UV light is used.

As the UV light illuminating apparatus, a lamp-type illuminating apparatus using a high pressure mercury lamp or a mercury xenon lamp as a light source has been long known, but recently, in keeping with the demand for reduced power consumption, a longer service life, and a compact device, a UV light illuminating apparatus using Light Emitting Diode (LED) as an alternative to a traditional discharge lamp for a light source is developed.

The UV light illuminating apparatus using LED as a light source is disclosed by, for example, Patent Literature 1. The UV light illuminating apparatus disclosed by Patent Literature 1 is equipped with a plurality of light illuminating modules, each having a light illuminating device on which a plurality of light emitting devices (LEDs) is mounted. The plurality of light illuminating modules is arranged and placed in a row, and is configured to irradiate UV light of a line shape to a predetermined area of an object to be illuminated placed facing the plurality of light illuminating modules.

If LED is used as a light source as described above, a majority of power inputted is converted to heat, resulting in lower light emitting efficiency and a shorter service life caused by heat generated from the LED itself, so coping with the heat is at an issue. Thus, the UV light illuminating apparatus disclosed by Patent Literature 1 employs the design for forced radiation of heat generated from the LED by placing a member for heat radiation on the surface opposite to each light illuminating device.

The member for heat radiation disclosed by Patent Literature 1 is based on so-called air cooling involving cooling down by a flow of coolant, but because pipe installation for coolant is needed, the device itself increases in size or there is a need to prevent leaks. Accordingly, air cooling-based heat radiation with high efficiency using heat pipe is proposed (for example, Patent Literature 2).

A light illuminating apparatus disclosed by Patent Literature 2 has heat pipe and a plurality of heat radiating fins that is inserted into and connected to the heat pipe, on the surface side opposite to a light emitting module having a plurality of light emitting devices (LEDs) mounted thereon, and employs the design for transferring heat generated from the LEDs through the heat pipe and radiating the heat in air from the heat radiating fins.

RELATED LITERATURES

Patent Literatures (Patent Literature 1) Japanese Patent Publication No. 2015-153771

(Patent Literature 2) Japanese Patent Publication No. 2014-038866

DISCLOSURE

Technical Problem

SUMMARY OF THE INVENTION

Problem to be Solved by the Invention

According to the heat radiating apparatus of the light illuminating apparatus disclosed by Patent Literature 2, because heat generated from the light emitting diodes (LEDs) is rapidly transferred by the heat pipe and is radiated from the plurality of heat radiating fins, the LEDs are efficiently cooled. Thereby, the performance degradation or damage of the LEDs is prevented, and high-brightness light emission is achieved. Furthermore, because the heat radiating apparatus disclosed by Patent Literature 2 is configured to transfer heat in a direction opposite to the emission direction of the LEDs by bending the heat pipe in the shape of ㅋ, the light illuminating apparatus can be reduced in size in a direction perpendicular to the emission direction of the LEDs.

However, in case that the heat pipe is bent in the shape of ㅋ like the heat radiating apparatus of Patent Literature 2, the curved part of the heat pipe gets lifted up from the base plate (support member) of the light emitting module and the cooling capacity of the corresponding lifted part significantly reduces, and to fully cool the entire base plate, the line part of the heat pipe needs to be placed in close contact over the entire surface opposite to the base plate, causing the problem that the curved part of the heat pipe protrudes out of the outside of the base plate (i.e., beyond the exterior of the light emitting module). Furthermore, if the curved part of the heat pipe protrudes out of the outside of the base plate, it is impossible to closely place in an arrangement direction of the LEDs (i.e., a direction in which the line part of the heat pipe extends), making it impossible to connect and place the light illuminating devices in a line shape, similar to the design disclosed by Patent Literature 1.

In view of these circumstances, the present disclosure is directed to providing a heat radiating apparatus that fully cools the entire base plate (support member) using heat pipe and allows for connection and arrangement in a line shape, and is further directed to providing a light illuminating apparatus with the heat radiating apparatus.

Technical Solution

To achieve the object, a heat radiating apparatus of the present disclosure is a heat radiating apparatus which is placed in close contact with a heat source to radiate heat of the heat source in air, and includes a support member which has a shape of a plate and is placed in close contact with the heat source on a first principal surface side, a heat pipe which is supported by the support member and is thermally joined with the support member to transfer the heat from the heat source, and a plurality of heat radiating fins which is placed in a space that faces a second principal surface opposite to the first principal surface and is thermally joined with the heat pipe to radiate the heat transferred by the heat pipe, wherein the heat pipe includes a first line part which is thermally joined with the support member, a second line part which is thermally joined with the plurality of heat radiating fins, and a connecting part which connects one end part of the first line part to one end part of the second line part such that the first line part and the second line part are successive, a length of the heat pipe in a direction in which the first line part extends is slightly shorter than or equal to a length of the support member in the direction in which the first line part extends, the connecting part has a curved part that is thermally joined with the support member in the proximity of one end part of the first line part, and when a plurality of heat radiating apparatuses are arranged in the direction in which the first line part extends, the heat radiating apparatuses can be connected such that the first principal surfaces are successive.

By this construction, in the direction in which the first line part extends, a cooling capacity difference is small, and the substrate can be equally (approximately uniformly) cooled, thus light emitting diode (LED) devices placed on the substrate are approximately uniformly cooled as well. Accordingly, as a temperature difference between each LED device is small, an irradiation intensity difference resulting from the temperature characteristics is also small. Furthermore, because the heat pipe and the heat radiating fins are configured not to deviate from the space that faces the second principal surface of the support member, a plurality of heat radiating apparatuses can be connected even in the direction in which the first line part extends.

Furthermore, preferably, the heat pipe is provided in multiple numbers, and the first line parts of the plurality of heat pipes are placed at a first predetermined interval in a direction approximately orthogonal to a direction in which the first line parts extend.

Furthermore, preferably, the second line parts of the plurality of heat pipes are approximately parallel to the second principal surface, and are placed at the first predetermined interval in a direction approximately orthogonal to the direction in which the first line parts extend.

Furthermore, preferably, the second line parts of the plurality of heat pipes are approximately parallel to the second principal surface, and are placed at a second predetermined interval that is longer than the first predetermined interval in a direction approximately orthogonal to the direction in which the first line parts extend.

Furthermore, a fan may be provided in the space that faces the second principal surface to generate an air current in a direction approximately perpendicular to the second principal surface.

Furthermore, preferably, locations of the second line parts of each heat pipe differ in a direction approximately perpendicular to and a direction approximately parallel to the second principal surface, when viewed in the direction in which the first line part extends. Furthermore, in this case, it is preferred to provide a fan which is placed in the space that faces the second principal surface to generate an air current in a direction approximately parallel to the second principal surface.

Furthermore, the plurality of heat radiating fins may have a cutout part in a space surrounded by the first line parts and the second line parts of the plurality of heat pipes, and a fan may be provided in a space formed by the cutout part to generate an air current in a direction inclined with respect to the second principal surface.

Furthermore, preferably, the second line part is approximately parallel to the second principal surface.

Furthermore, preferably, the support member has a groove part in a shape that conforms to the first line part and the curved part on the second principal surface side, and is placed such that the first line part and the curved part are inserted and put into the groove part.

Further, in another aspect, a light illuminating apparatus of the present disclosure includes any one heat radiating apparatus described above, a substrate placed in close contact with the first principal surface, and a plurality of LED devices placed approximately parallel to the first line part of the heat pipe on a surface of the substrate.

Furthermore, preferably, the plurality of LED devices is placed at a predetermined pitch in a direction in which the first line part extends, and a distance from the first line part to one end of the support member and a distance from the connecting part to the other end of the support member in the direction in which the first line part extends are ½ or less of the pitch.

Furthermore, preferably, the plurality of LED devices is placed in multiple rows in a direction approximately orthogonal to the direction in which the first line part extends.

Furthermore, preferably, the plurality of LED devices is placed at a location opposite to the first line part with the substrate interposed between.

Furthermore, the light illuminating apparatus may include the plurality of heat radiating apparatuses connected such that the first principal surfaces are successive. Furthermore, in this case, preferably, the plurality of heat radiating apparatuses is arranged and connected in the direction in which the first line part extends.

Furthermore, preferably, the LED device emits light of a wavelength that acts on an ultraviolet curable resin.

Advantageous Effects

As described above, according to the present disclosure, it is possible to realize a heat radiating apparatus that fully cools the entire base plate (support member) using the heat pipe and allows for connection and arrangement in a line shape, and a light illuminating apparatus with the corresponding heat radiating apparatus.

DETAILED DESCRIPTION OF MAIN ELEMENTS

Figure 1A:
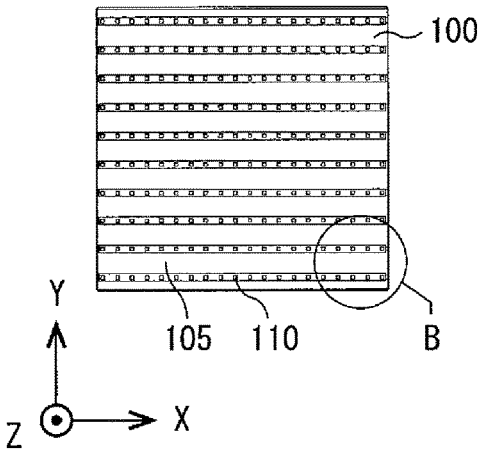
FIGS. 1A, 1B, 1C, 1D and 1E are diagrams of outward appearance schematically illustrating the construction of a light illuminating apparatus with a heat radiating apparatus according to a first embodiment of the present disclosure.
Figure 1B:
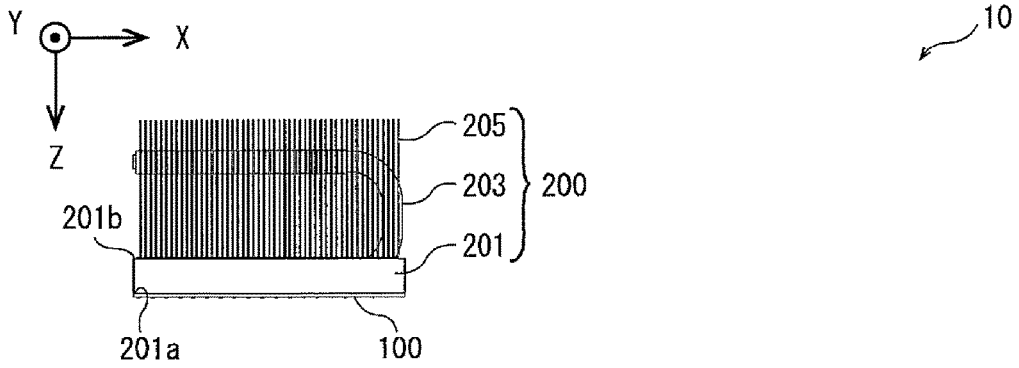

10, 10M, 20, 20M, 30, 30M, 40, 40M: Light illuminating apparatus
100: LED unit
105: Substrate
110: LED device
200, 200M, 200A, 200AM, 200B, 200BM, 200C, 200CM: Heat radiating apparatus
201, 201A, 201B, 201C: Support member
201A, 201Aa, 201Ba, 201Ca: First principal surface
201*b*, 201Ab, 201Bb, 201Cb: Second principal surface
201*c*: Groove part
203, 203A, 203B, 203C: Heat pipe
203*a*, 203Aa, 203Ba, 203Ca: First line part
203*b*, 203Ab, 203Bb, 203Cb: Second line part
203*c*, 203Cc: Connecting part
203*ca*, 203*cb*: Curved part
205, 205A, 205B, 205C: Heat radiating fin
205*a*: Through-hole
205Ca: Cutout part
210, 210A, 210B, 210C: Cooling fan

BEST MODE

Mode for Carrying Out the Invention

Hereinafter, the embodiments of the present disclosure will be described in detail with reference to the accompanying drawings. Furthermore, in the drawings, the same or equivalent elements are assigned with the same reference numerals, and its description is not repeated herein.

First Embodiment

FIG. 1 is a diagram of outward appearance schematically illustrating the construction of a light illuminating apparatus 10 with a heat radiating apparatus 200 according to a first embodiment of the present disclosure. The light illuminating apparatus 10 of this embodiment is an apparatus that is mounted in a light source apparatus for curing an ultraviolet (UV) curable ink used as an ink for sheet-fed offset printing or a UV curable resin used as an adhesive in Flat Panel Display (FPD), and is placed facing an object to be illuminated to emit UV light to a predetermined area of the object to be illuminated. As used herein, a direction in which first line parts 203*a* of heat pipes 203 of the heat radiating apparatus 200 extend is defined as X-axis direction, a direction in which the first line parts 203*a* of the heat pipes 203 are arranged is defined as Y-axis direction, and a direction orthogonal to X axis and Y axis is defined as Z-axis direction. Furthermore, because the required irradiation area differs according to the use or specification of the light source apparatus in which the light illuminating apparatus 10 is mounted, the light illuminating apparatus 10 of this embodiment is configured to allow for connection in X-axis direction and Y-axis direction (as described in detail below).

(Construction of the Light Illuminating Apparatus 10)

As shown in FIG. 1, the light illuminating apparatus 10 of this embodiment includes a light emitting diode (LED) unit 100 and the heat radiating apparatus 200. Furthermore, FIG. 1A is a front view (a diagram when viewed from the Z-axis direction downstream side (positive direction side)) of the light illuminating apparatus 10 of this embodiment, FIG. 1B is a plane view (a diagram when viewed from the Y-axis direction downstream side (positive direction side)), FIG. 1C is a right side view (a diagram when viewed from the X-axis direction downstream side (positive direction side)), FIG. 1D is a left side view (a diagram when viewed from the X-axis direction upstream side (negative direction side)), and FIG. 1E is a bottom view (a diagram when viewed from the Z-axis direction upstream side (negative direction side)).

(Construction of the LED Unit 100)

Figure 1C:
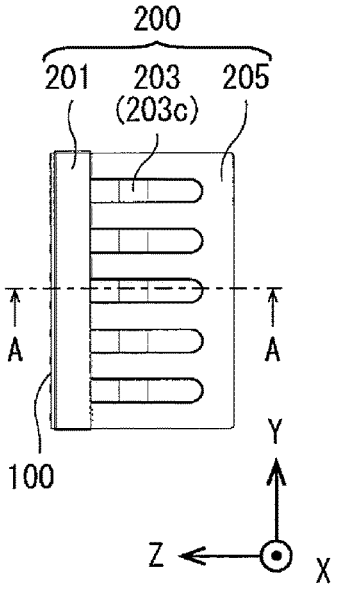
Figure 1D:
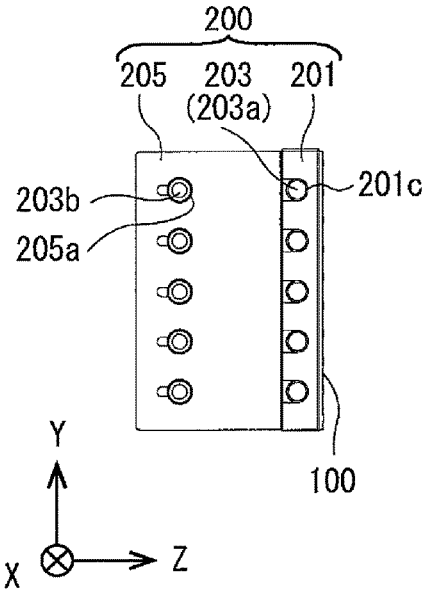
Figure 1E:
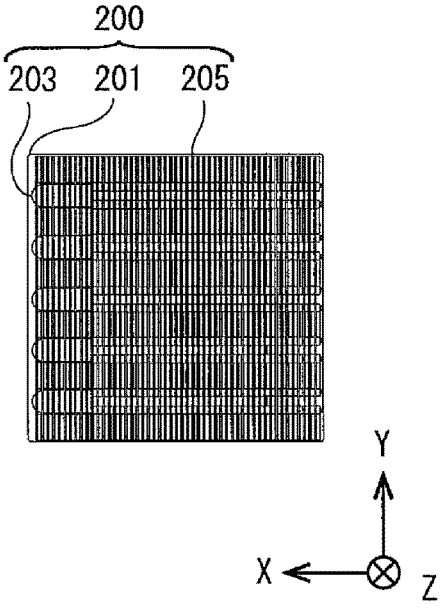
Figure 2:
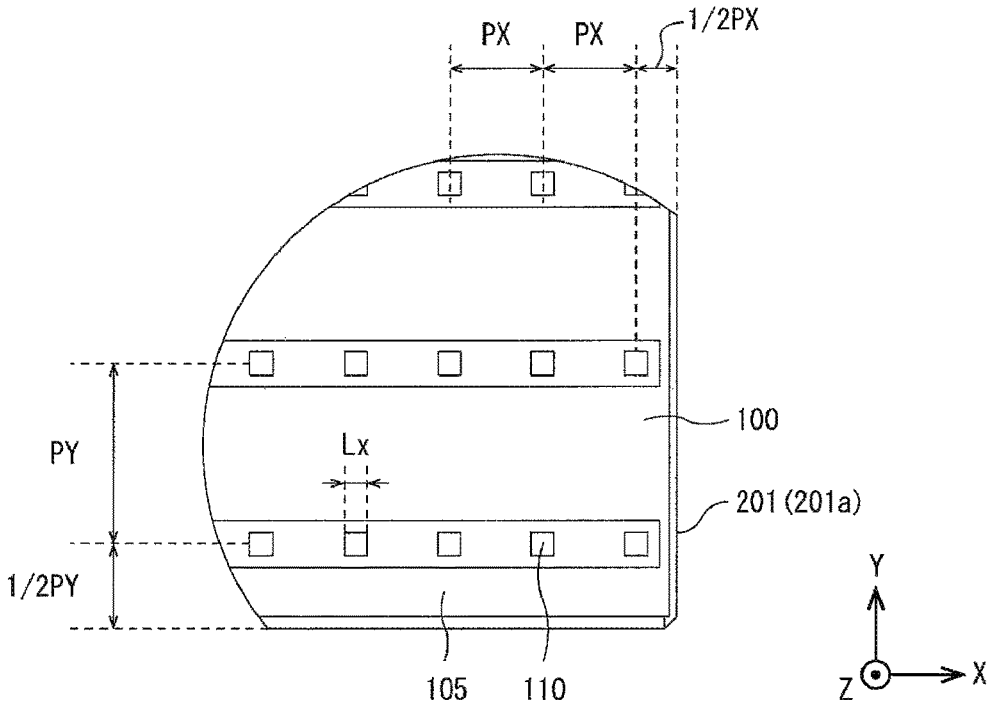
FIG. 2 is a diagram illustrating the construction of a light emitting diode (LED) unit provided in a light illuminating apparatus with a heat radiating apparatus according to a first embodiment of the present disclosure.

FIG. 2 is a diagram illustrating the construction of the LED unit 100 of this embodiment, and is an enlarged view of section B in FIG. 1. As shown in FIGS. 1A and 2, the LED unit 100 is equipped with a substrate 105 of a rectangular plate shape approximately parallel to X-axis direction and Y-axis direction, and a plurality of LED devices 110 placed on the substrate 105.

The substrate 105 is a rectangular shaped wiring substrate formed of a material having high thermal conductivity (for example, copper, aluminum, and aluminum nitride), and as shown in FIG. 1A, the substrate 105 has 200 LED devices 110 mounted on the surface in 20 columns (X-axis direction)×10 rows (Y-axis direction) arrangement at a predetermined interval in X-axis direction and Y-axis direction by Chip On Board (COB) technology. An anode pattern (not shown) and a cathode pattern (not shown) for supplying power to each LED device 110 are formed on the substrate 105, and each LED device 110 is electrically connected to the anode pattern and the cathode pattern, respectively. Furthermore, the substrate 105 is electrically connected to a LED driving circuit (not shown) with a wiring cable not shown, and each LED device 110 is supplied with a drive current from the LED driving circuit through the anode pattern and the cathode pattern.

The LED device 110 is a semiconductor device that is supplied with the drive current from the LED driving circuit to emit UV light (for example, 365 nm, 385 nm, 395 nm, 405 nm wavelength). In this embodiment, 20 LED devices 110 are arranged at a predetermined column pitch PX in X-axis direction, and with 20 LED devices in each row, 10 rows of LED devices 110 are arranged at a predetermined row pitch PY in Y-axis direction (FIG. 2). Accordingly, when the drive current is supplied to each LED device 110, UV light in the shape of 10 lines approximately parallel to X-axis direction is emitted from the LED unit 100. Furthermore, each LED device 110 of this embodiment is supplied to the drive current adjusted to emit an approximately equal amount of UV light, and UV light emitted from the LED unit 100 has approximately uniform light quantity distribution in X-axis direction and Y-axis direction. Furthermore, the light illuminating apparatus 10 of this embodiment is configured to allow for connection in X-axis direction and Y-axis direction to change an irradiation area, and for successive arrangement of the LED devices 110 between adjacent light illuminating apparatuses 10 when connected, the LED devices 110 disposed at the two end parts in X-axis direction are placed at the position of ½PX from the edge of the support member 201 of the heat radiating apparatus 200, and the LED devices 110 disposed at the two end parts in Y-axis direction are placed at the position of ½PY from the edge of the support member 201 of the heat radiating apparatus 200 (FIG. 2).

(Construction of the Heat Radiating Apparatus 200)

Figure 3A:
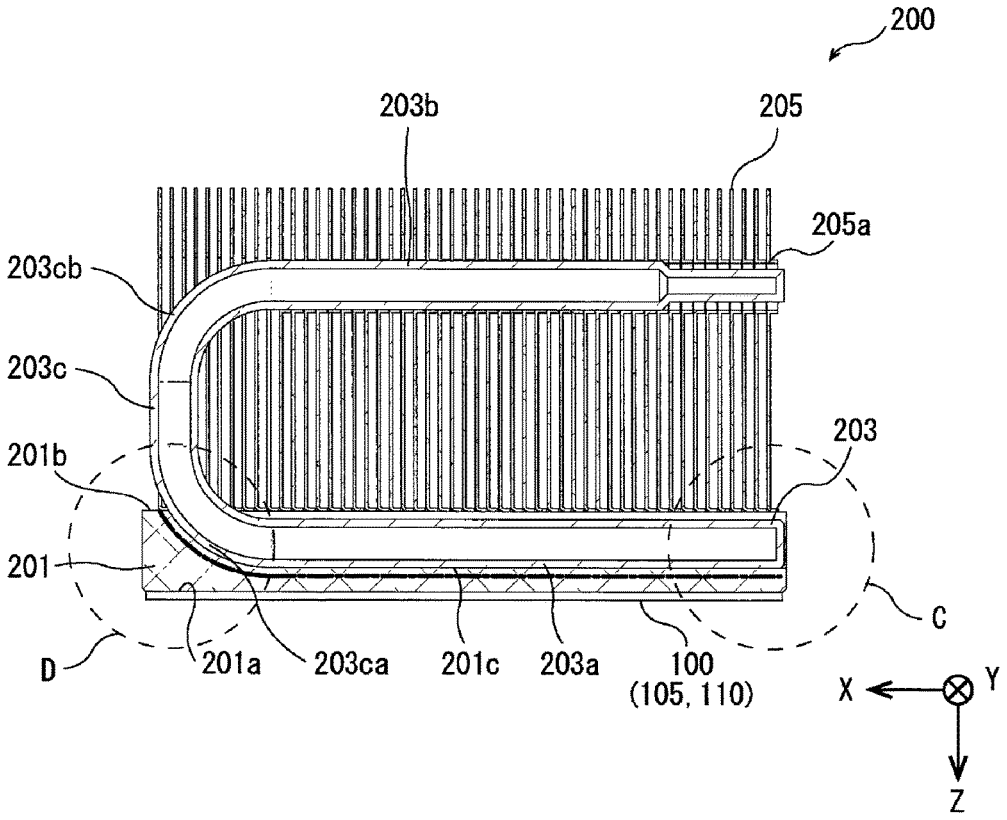
FIGS. 3A, 3B and 3C are diagrams illustrating the construction of a heat radiating apparatus according to a first embodiment of the present disclosure.
Figure 3B:
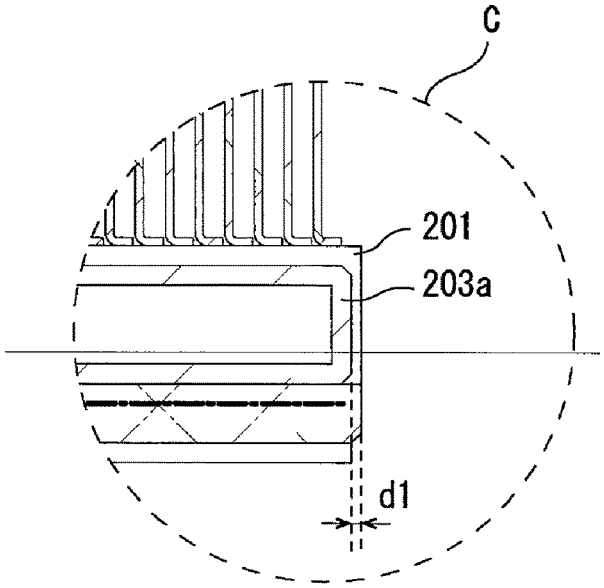
Figure 3C:
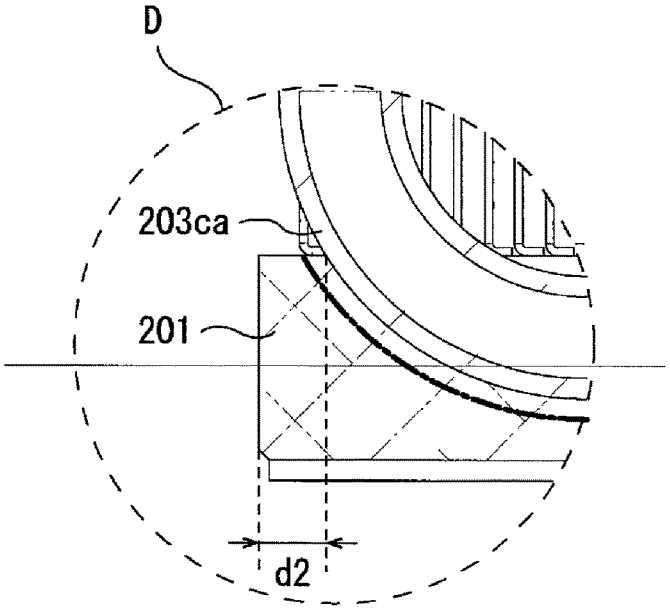

FIG. 3 is a diagram illustrating the construction of the heat radiating apparatus 200 of this embodiment. FIG. 3A is a cross-sectional view taken along the line A-A in FIG. 1C, FIG. 3B is an enlarged view of section C in FIG. 3A, and FIG. 3C is an enlarged view of section D in FIG. 3A. The heat radiating apparatus 200 is an apparatus that is placed in close contact with the surface opposite to the substrate 105 of the LED unit 100 (a surface on the opposite side to the surface on which the LED device 110 is mounted) to radiate heat generated from each LED device 110, and includes a support member 201, a plurality of heat pipes 203, and a plurality of heat radiating fins 205. When the drive current flows into each LED device 110 and UV light is emitted from each LED device 110, the temperature increases by self-heat generation of the LED device 110, causing a significant reduction in light emitting efficiency. For this reason, in this embodiment, the heat radiating apparatus 200 is installed in close contact with the surface opposite to the substrate 105, and the heat generated from the LED device 110 is forcibly radiated by conduction toward the heat radiating apparatus 200 through the substrate 105.

The support member 201 is a member of a rectangular plate shape formed of metal having high thermal conductivity (for example, copper and aluminum). The support member 201 has a first principal surface 201*a* attached tightly to the surface opposite to the substrate 105 through a heat conducting member such as grease, to receive heat generated from the LED unit 100 serving as a heat source. On a second principal surface 201*b* (a surface opposite to the first principal surface 201*a*) of the support member 201 of this embodiment, a groove part 201*c* is formed to conform to the shape of a first line part 203*a* and a curved part 203*ca* of a heat pipe 203 as described below (FIG. 1D, FIG. 3) to support the heat pipe 203 by the support member 201. As described above, the support member 201 of this embodiment is configured to support the heat pipe 203 as well as to act as a heat receiving part to receive heat from the LED unit 100.

The heat pipe 203 is a hermetically closed pipe of metal (for example, metal such as copper, aluminum, iron and magnesium, or alloys thereof) having a hollow of an approximately circular shape in cross section, in which a working fluid (for example, water, alcohol, and ammonia) is filled under reduced pressure. As shown in FIG. 3, each heat pipe 203 of this embodiment has an approximately inverted ⊐ shape when viewed in Y-axis direction, and includes a first line part 203*a* extending in X-axis direction, a second line part 203*b* extending in X-axis direction approximately parallel to the first line part 203*a*, and a connecting part 203*c* connecting one end of the first line part 203*a* (X-axis direction downstream side (positive direction side)) to one end of the second line part 203*b* (X-axis direction downstream side (positive direction side)) such that the first line part 203*a* and the second line part 203*b* are successive. Furthermore, the heat pipe 203 of this embodiment is placed without deviating from a space that faces the second principal surface 201*b* of the support member 201 to prevent the interference between the light illuminating apparatuses 10 when connected.

The first line parts 203*a* of each heat pipe 203 are a part that receives heat from the support member 201, and the first line parts 203*a* of each heat pipe 203 are inserted into the groove part 201*c* of the support member 201 and fixed by a fastener or an adhesive not shown, and are thermally coupled with the support member 201 (FIG. 3). In this embodiment, the first line parts 203*a* of 5 heat pipes 203 are equally arranged at a predetermined interval in Y-axis direction (FIG. 10, FIG. 1D).

The second line parts 203*b* of each heat pipe 203 are a part that radiates heat received by the first line part 203*a*, and the second line parts 203*b* of each heat pipe 203 are inserted into and pass through a through-hole 205*a* of the heat radiating fin 205, and are mechanically and thermally coupled with the heat radiating fin 205 (FIG. 3). In this embodiment, the second line parts 203*b* of 5 heat pipes 203 are arranged and placed at a predetermined interval in Y-axis direction (FIG. 10, FIG. 1D). Furthermore, the length of the second line parts 203*b* of each heat pipe 203 of this embodiment is approximately equal to the length of the first line parts 203*a*.

The connecting parts 203*c* of each heat pipe 203 extend from one end of the first line part 203*a* to the Z-axis direction upstream side (negative direction side) such that they protrude from the second principal surface 201*b* of the support member 201, and are connected to one end of the second line part 203*b*. That is, the connecting part 203*c* turns back to the second line part 203*b* such that the second line part 203*b* is approximately parallel to the first line part 203*a*. Curved parts 203*ca* and 203*cb* are formed near the first line part 203*a* and the second line part 203*b* of the connecting parts 203*c* of each heat pipe 203 to prevent buckling of the connecting parts 203*c*. Furthermore, in this embodiment, the curved part 203*ca* is also inserted into the groove part 201*c* and fixed in place, and is thermally coupled with the support member 201.

The heat radiating fin 205 is a member of metal (for example, metal such as copper, aluminum, iron and magnesium, or alloys thereof) with a rectangular plate shape. As shown in FIG. 3, each heat radiating fin 205 of this embodiment has the through-hole 205*a* into which the second line parts 203*b* of each heat pipe 203 are inserted. In this embodiment, 50 heat radiating fins 205 are inserted into the second line parts 203*b* of each heat pipe 203 in a sequential order, and are arranged and placed at a predetermined interval in X-axis direction. Furthermore, each heat radiating fin 205 is, at each through-hole 205*a*, mechanically and thermally coupled with the second line parts 203*b* of each heat pipe 203 by welding or soldering. Furthermore, the heat radiating fin 205 of this embodiment are placed without deviating from a space that faces the second principal surface 201*b* of the support member 201 to prevent the interference between the light illuminating apparatuses 10 when connected.

When the drive current flows into each LED device 110 and UV light is emitted from each LED device 110, the temperature increases by self-heat generation of the LED device 110, but heat generated from each LED device 110 is rapidly conducted (moved) to the first line parts 203*a* of each heat pipe 203 through the substrate 105 and the support member 201. Furthermore, when heat is moved to the first line parts 203*a* of each heat pipe 203, the working fluid in each heat pipe 203 absorbs the heat where it vaporizes, and vapor of the working fluid moves through the hollow in the connecting part 203*c* and the second line part 203*b*, allowing the heat of the first line part 203*a* to move to the second line part 203*b*. Furthermore, the heat moved to the second line part 203*b* moves to the plurality of heat radiating fins 205 coupled to the second line part 203*b*, and is radiated in air from each heat radiating fin 205. When the heat is radiated from each heat radiating fin 205, the temperature of the second line part 203*b* reduces, and thus, vapor of the working fluid in the second line part 203*b* is cooled down and returns to liquid, and moves to the first line part 203*a*. Furthermore, the working fluid moving to the first line part 203*a* is used to absorb heat conducted newly through the substrate 105*a* and the support member 201.

As described above, in this embodiment, the working fluid in each heat pipe 203 circulates between the first line part 203*a* and the second line part 203*b*, allowing heat generated from each LED device 110 to rapidly move to the heat radiating fin 205 and to be efficiently radiated in air from the heat radiating fin 205. Thereby, the temperature of the LED device 110 does not increase too much, and a problem such as a significant reduction in light emitting efficiency does not occur.

Furthermore, the cooling capacity of the heat radiating apparatus 200 is determined by the amount of transferred heat of the heat pipe 203 and the amount of radiated heat of the heat radiating fin 205. Furthermore, when a temperature difference occurs between each LED device 110 arranged in two dimensions on the substrate 105, an irradiation intensity difference resulting from the temperature characteristics occurs, and accordingly, from the viewpoint of irradiation intensity, it is required to uniformly cool the substrate 105 along X-axis direction and Y-axis direction, and especially because the light illuminating apparatus 10 of this embodiment is configured to allow for connection in X-axis direction and Y-axis direction and the LED device 110 is disposed even near the end part of the support member 201, there is a need to uniformly cool even the proximity of the end part of the support member 201.

Accordingly, the heat radiating apparatus 200 of this embodiment is configured such that the length of X-axis direction of each heat pipe 203 is slightly shorter than or equal to the length of X-axis direction of the support member 201, and the first line parts 203*a* and the curved parts 203*ca* of each heat pipe 203 are thermally joined with the support member 201, to achieve uniform cooling in X-axis direction. That is, because of being configured to receive heat from the support member 201 using the first line parts 203*a* and the curved parts 203*ca* of each heat pipe 203, each heat pipe 203 does not protrude in X-axis direction, and uniform cooling is achieved throughout the two end parts of X-axis direction of the support member 201. Furthermore, with regard to Y-axis direction, the plurality of heat pipes 203 is equally arranged in Y-axis direction, achieving uniform cooling along Y-axis direction. Furthermore, as shown in FIG. 3B, a distance d1 from the front end of the first line parts 203*a* of each heat pipe 203 to the edge of the support member 201 is preferably ½ or less of the size Lx of X-axis direction of the LED device 110 (as shown in FIG. 2). Furthermore, likewise, as shown in FIG. 3C, a distance d2 from the curved parts 203*ca* of each heat pipe 203 to the edge of the support member 201 is preferably ½ or less of the size Lx of X-axis direction of the LED device 110.

As described above, according to this embodiment, in Y-axis direction and X-axis direction, a cooling capacity difference is small, thus the substrate 105 is equally (approximately uniformly) cooled, and 200 LED devices 110 placed on the substrate 105 are approximately uniformly cooled as well. Accordingly, as a temperature difference between each LED device 110 is small, an irradiation intensity difference resulting from the temperature characteristics is also small. Furthermore, because the heat pipe 203 and the heat radiating fin 205 of this embodiment are configured not to deviate from a space that faces the second principal surface 201*b* of the support member 201 as shown in FIGS. 1 and 3, there is no interference between the light illuminating apparatuses 10 when connected.

Figure 4A:
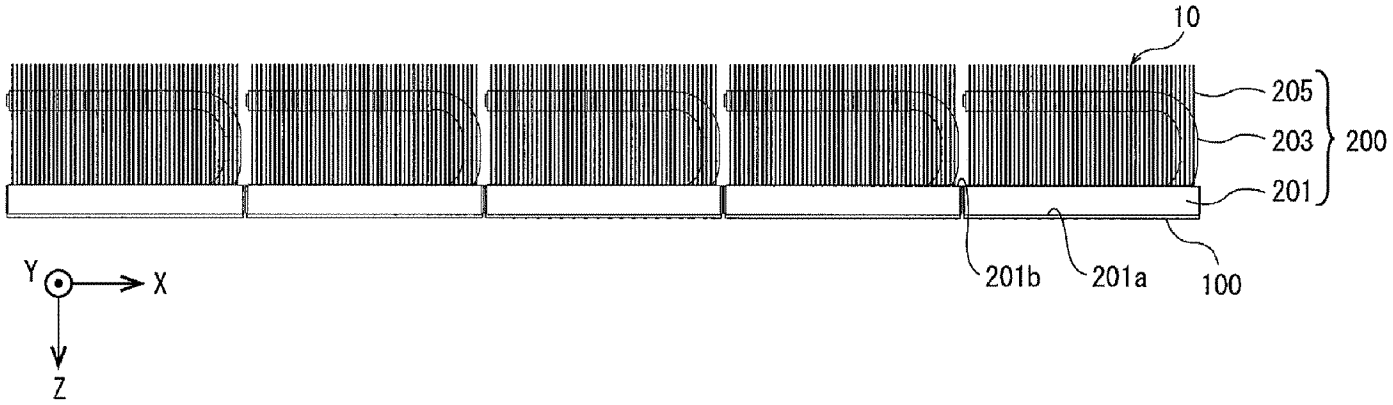
FIGS. 4A and 4B are diagrams showing that light illuminating apparatuses with heat radiating apparatuses according to a first embodiment of the present disclosure are connected in X-axis direction.
Figure 4B:
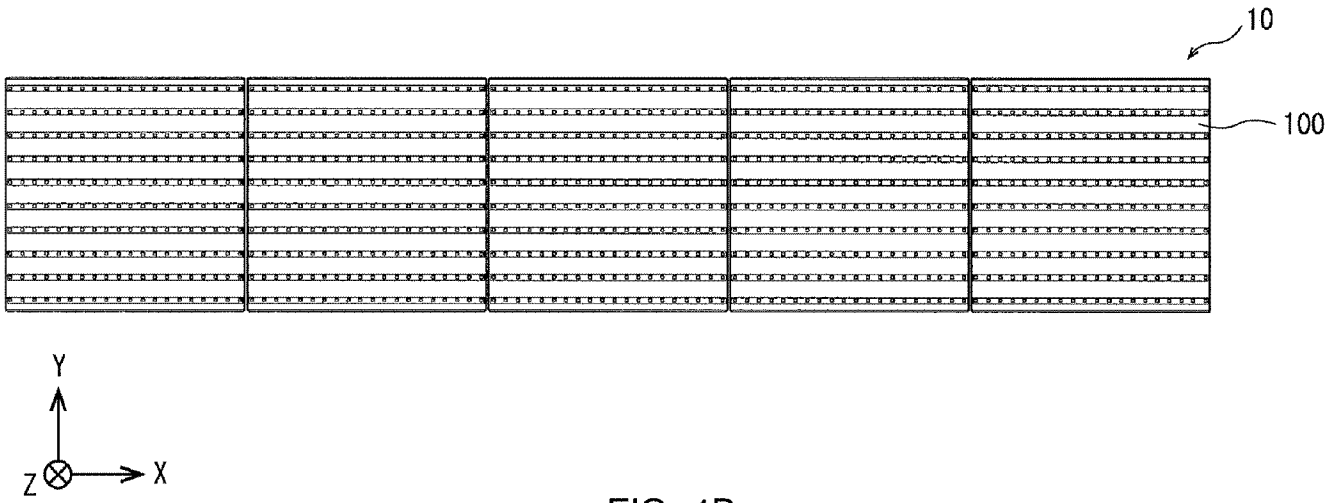

FIG. 4 is a diagram showing that the light illuminating apparatuses 10 of this embodiment are connected in X-axis direction, FIG. 4A is a plane view (a diagram when viewed from the Y-axis direction downstream side (positive direction side)), and FIG. 4B is a front view (a diagram when viewed from the Z-axis direction downstream side (positive direction side)). As shown in FIG. 4A, because the light illuminating apparatus 10 of this embodiment has the heat pipe 203 and the heat radiating fin 205 configured not to deviate from a space that faces the second principal surface 201*b* of the support member 201, it is possible to connect and arrange the light illuminating apparatuses 10 by joining the support members 201 such that the first principal surfaces 201*a* of the support members 201 are successive (i.e., the LED devices 110 are arranged in succession between adjacent light illuminating apparatuses 10). Accordingly, it is possible to form an irradiation area of a line shape with many sizes according to the specification or the use.

Figure 5A:
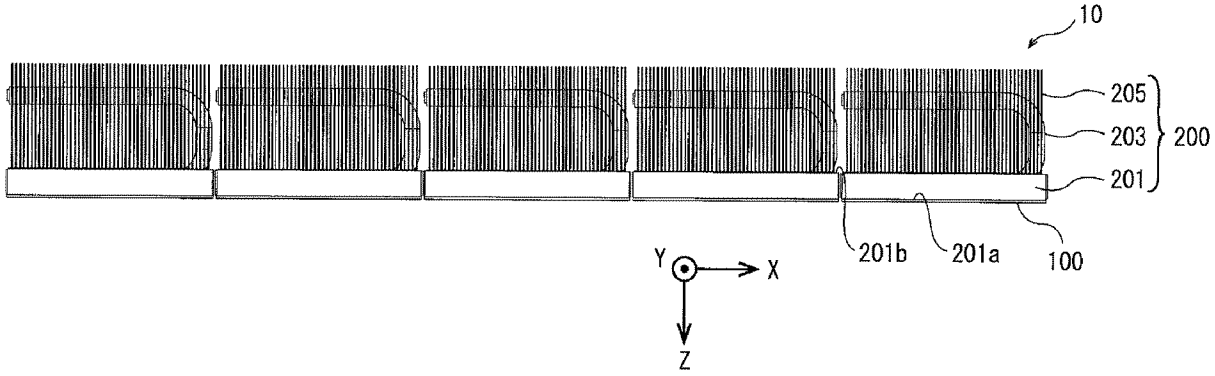
FIGS. 5A and 5B are diagrams showing that light illuminating apparatuses with heat radiating apparatuses according to a first embodiment of the present disclosure are connected in X-axis direction and Y-axis direction.
Figure 5B:
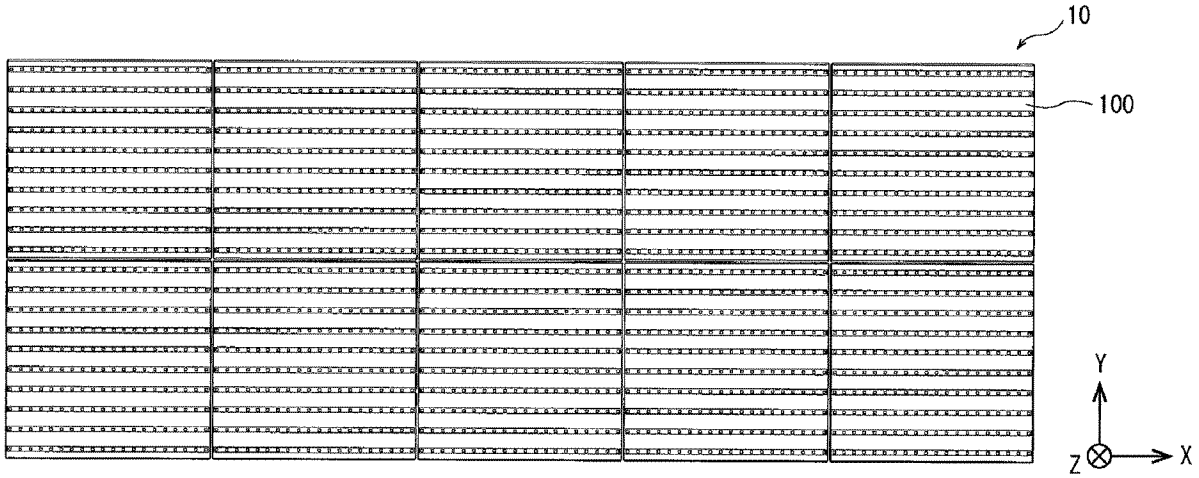

FIG. 5 is a diagram showing that the light illuminating apparatuses 10 of this embodiment are connected in X-axis direction and Y-axis direction, FIG. 5A is a plane view (a diagram when viewed from the Y-axis direction downstream side (positive direction side)), and FIG. 5B is a front view (a diagram when viewed from the Z-axis direction downstream side (positive direction side)). As shown in FIG. 5, because the light illuminating apparatus 10 of this embodiment has the heat pipe 203 and the heat radiating fin 205 configured not to deviate from a space that faces the second principal surface 201*b* of the support member 201, it is possible to arrange the light illuminating apparatuses 10 in matrix format by joining the support members 201 such that the first principal surfaces 201*a* of the support members 201 are successive (i.e., the LED devices 110 are arranged in succession between adjacent light illuminating apparatuses 10). Accordingly, it is possible to form an irradiation area with many sizes according to the specification or the use.

While this embodiment has been hereinabove described, the present disclosure is not limited to the above construction, and many variations may be made within the scope of the technical spirit of the present disclosure.

For example, although the heat radiating apparatus 200 of this embodiment is configured to include 5 heat pipes 203 arranged at a predetermined interval in Y-axis direction and 50 heat radiating fins 205 as shown in FIG. 1, the number of the heat pipes 203 and the number of the heat radiating fins 205 is not limited thereto. The number of the heat radiating fins 205 is set in relation to the amount of generated heat of the LED device 110 or the temperature of air around the heat radiating fin 205, and is appropriately selected based on a so-called fin area that can radiate the heat generated from the LED device 110. Furthermore, the number of the heat pipes 203 is set in relation to the amount of generated heat of the LED device 110 or the amount of transferred heat of each heat pipe 203, and is appropriately selected so that the heat generated from the LED device 110 can be sufficiently transferred.

Furthermore, although the LED devices 110 are arranged in 20 columns (X-axis direction)×10 rows (Y-axis direction) on the substrate 105 and 5 heat pipes 203 are arranged on the surface side opposite to the substrate 105 in this embodiment, from the viewpoint of cooling efficiency, it is preferred to place each LED device 110 on the substrate 105 at the location opposite to the first line part 203*a* of each heat pipe 203.

Furthermore, although this embodiment describes that the first line parts 203*a* and the second line parts 203*b* of 5 heat pipes 203 are equally arranged at a predetermined interval in Y-axis direction (FIG. 10, FIG. 1D), the present disclosure is not necessarily limited thereto. The interval of the first line parts 203*a* and the second line parts 203*b* may be configured to gradually increase (or decrease) depending on the arrangement of the LED devices 110.

Furthermore, although this embodiment describes natural air cooling of the heat radiating apparatus 200, forced air cooling of the heat radiating apparatus 200 is made possible by further installing a fan in the heat radiating apparatus 200 to supply cooling air.

(Variation 1)

Figure 6A:
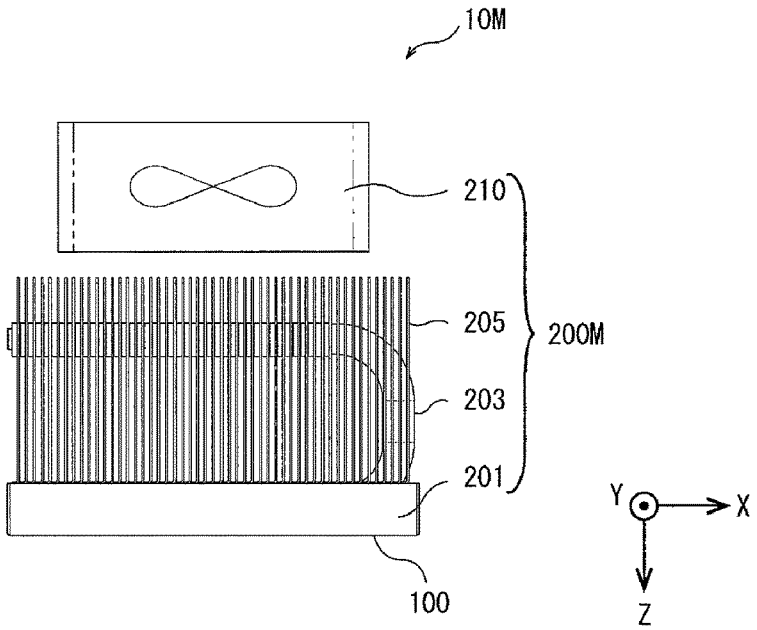
FIGS. 6A and 6B are diagrams showing the construction of a variation of a heat radiating apparatus according to a first embodiment of the present disclosure.
Figure 6B:
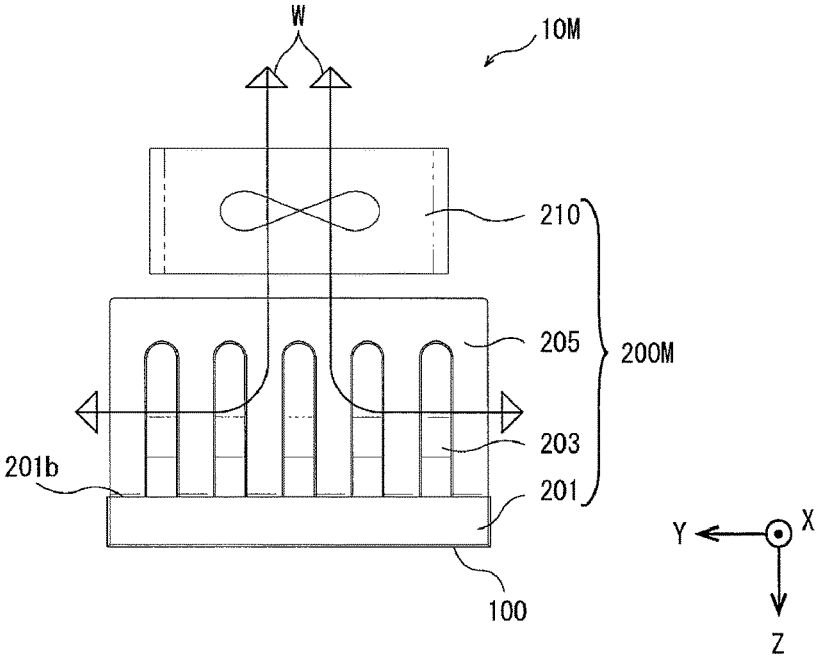
Figure 7A:
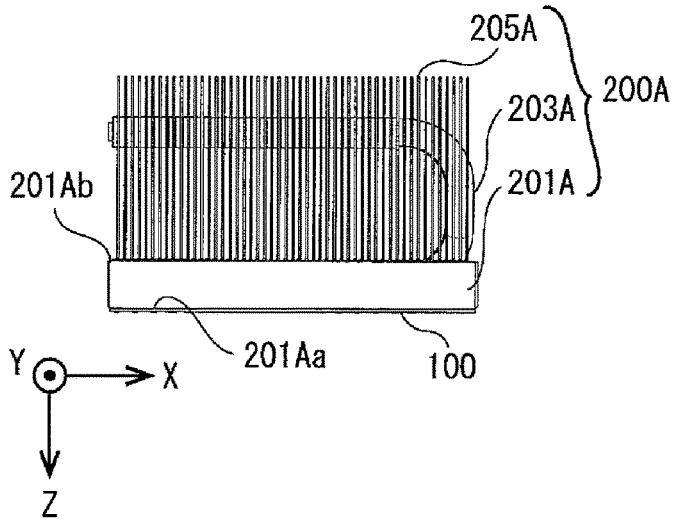
FIGS. 7A, 7B, 7C and 7D are diagrams of outward appearance schematically illustrating the construction of a light illuminating apparatus with a heat radiating apparatus according to a second embodiment of the present disclosure.
Figure 7B:
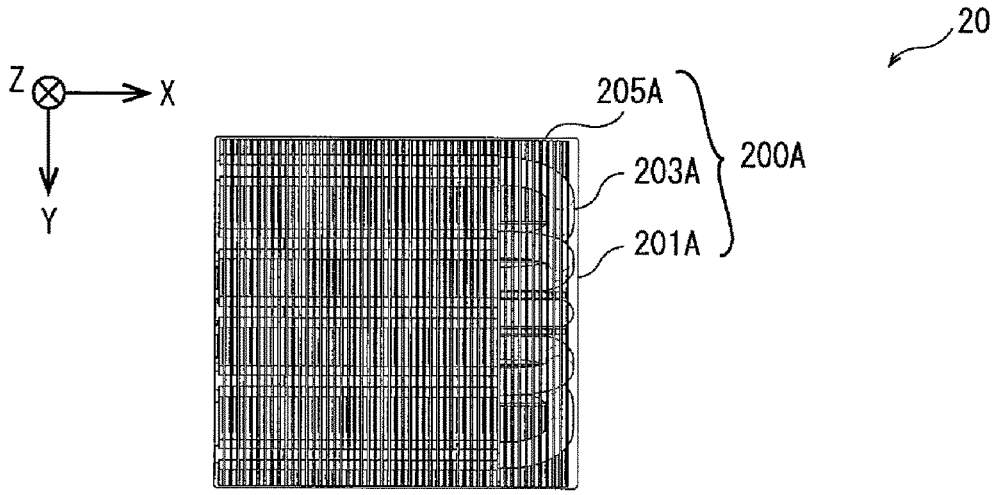
Figure 7C:
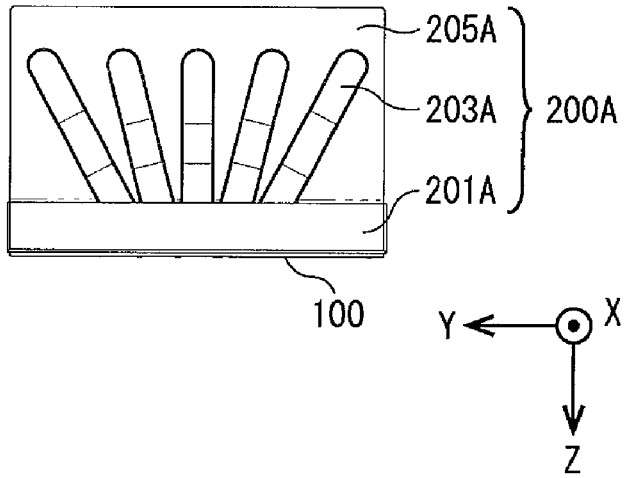
Figure 7D:
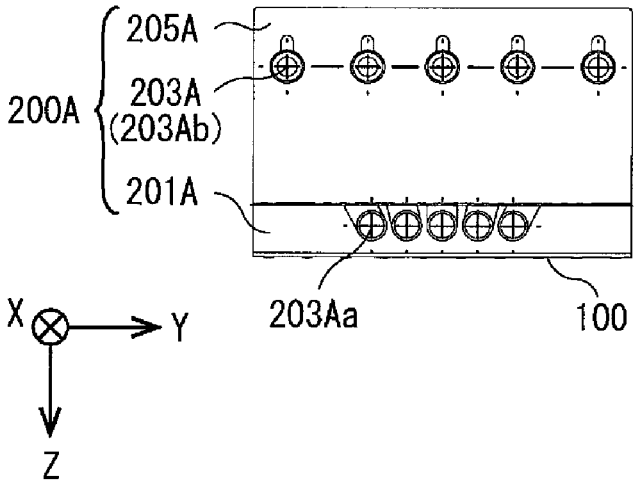

FIG. 6 is a diagram showing a light illuminating apparatus 10M with a heat radiating apparatus 200M according to a variation of the heat radiating apparatus 200 of this embodiment. FIG. 6A is a plane view (a diagram when viewed from the Y-axis direction downstream side (positive direction side)) of the light illuminating apparatus 10M of this variation, and FIG. 6B is a right side view (a diagram when viewed from the X-axis direction downstream side (positive direction side)). As shown in FIG. 6, the light illuminating apparatus 10M of this variation is different from the light illuminating apparatus 10 of this embodiment in the respect that the heat radiating apparatus 200M has a cooling fan 210.

The cooling fan 210 is a device that is placed at the Z-axis direction upstream side (negative direction side) of the heat radiating apparatus 200M to supply cooling air to the heat radiating apparatus 200M. As shown in FIG. 6B, the cooling fan 210 generates an air current W in a direction perpendicular to the second principal surface 201*b* of the support member 201 (i.e., a Z-axis direction or a direction opposite to the Z-axis direction). The air current W generated by the cooling fan 210 flows between each heat radiating fin 205, and cools each heat radiating fin 205, as well as the second line part 203*b* of each heat pipe 203 inserted into and passing through each heat radiating fin 205, and the second principal surface 201*b* of the support member 201. Accordingly, by the construction of this variation, the cooling capacity of the heat radiating apparatus 200M can be remarkably improved. Furthermore, the cooling fan 210 can be applied to the construction in which the light illuminating apparatuses 10M are connected as shown in FIGS. 4 and 5, and in this case, one cooling fan 210 may be formed for each heat radiating apparatus 200M, and one cooling fan 210 may be formed for the plurality of heat radiating apparatuses 200M.

Second Embodiment

Figure 8:
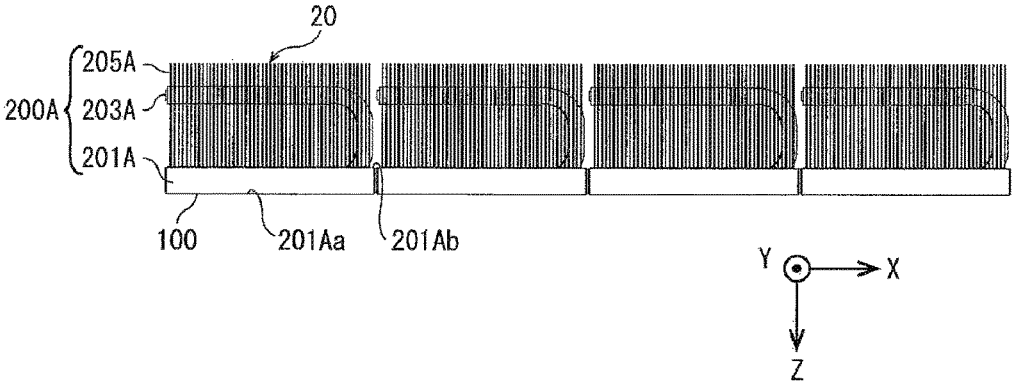
FIG. 8 is a diagram showing that heat radiating apparatuses according to a second embodiment of the present disclosure are connected.

FIG. 7 is a diagram of outward appearance schematically illustrating the construction of a light illuminating apparatus 20 with a heat radiating apparatus 200A according to a second embodiment of the present disclosure. FIG. 7A is a plane view (a diagram when viewed from the Y-axis direction downstream side (positive direction side)) of the light illuminating apparatus 20 of this embodiment, FIG. 7B is a bottom view (a diagram when viewed from the Z-axis direction upstream side (negative direction side)), FIG. 7C is a right side view (when viewed from the X-axis direction downstream side (positive direction side)), and FIG. 7D is a left side view (a diagram when viewed from the X-axis direction upstream side (negative direction side)). The light illuminating apparatus 20 of this embodiment is different from the heat radiating apparatus 200 of the first embodiment in the respect that an arrangement interval of first line parts 203Aa of heat pipes 203A is narrow and an arrangement interval of second line parts 203Ab is wide. That is, in the heat radiating apparatus 200A of this embodiment, the first line parts 203Aa of each heat pipe 203A are arranged approximately parallel in Y-axis direction in the proximity of the center part of a support member 201A when viewed in X-axis direction, and the second line parts 203Ab of each heat pipe 203A are arranged approximately parallel in Y-axis direction at an interval that is wider than the interval of the first line parts 203Aa when viewed in X-axis direction. By this construction, the cooling capacity at the center part of the support member 201A can be increased, and thus, it is effective, for example, in the case that the LED devices 110 of the LED unit 100 are intensively arranged at the rough center part of Y-axis direction of the substrate 105. Furthermore, because the light illuminating apparatus 20 of this embodiment has the heat pipes 203A and heat radiating fins 205A configured not to deviate from a space that faces a second principal surface 201Ab of the support member 201A in the same way as the light illuminating apparatus 10 of the first embodiment, it is possible to connect and arrange the light illuminating apparatuses 20 by joining the support members 201A such that the first principal surfaces 201Aa of the support members 201A are successive as shown in FIG. 8.

(Variation 2)

Figure 9:
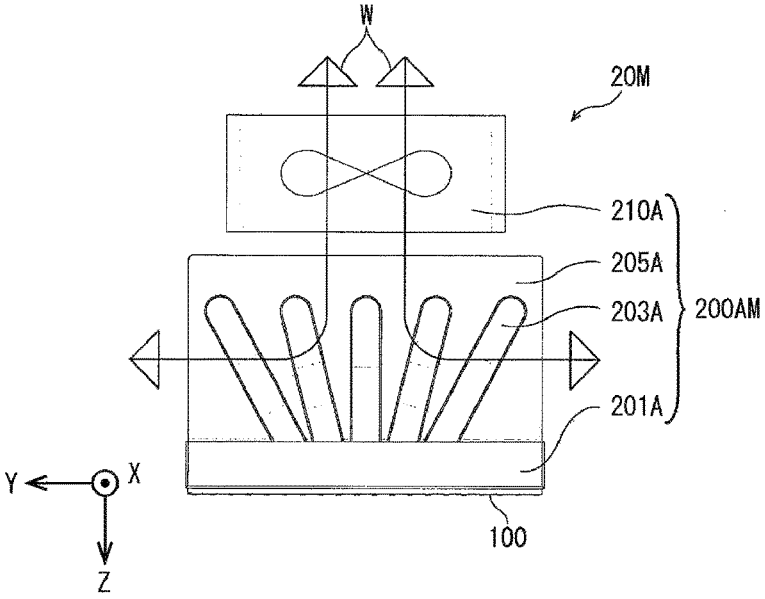
FIG. 9 is a diagram showing the construction of a variation of a heat radiating apparatus according to a second embodiment of the present disclosure.
Figure 10A:
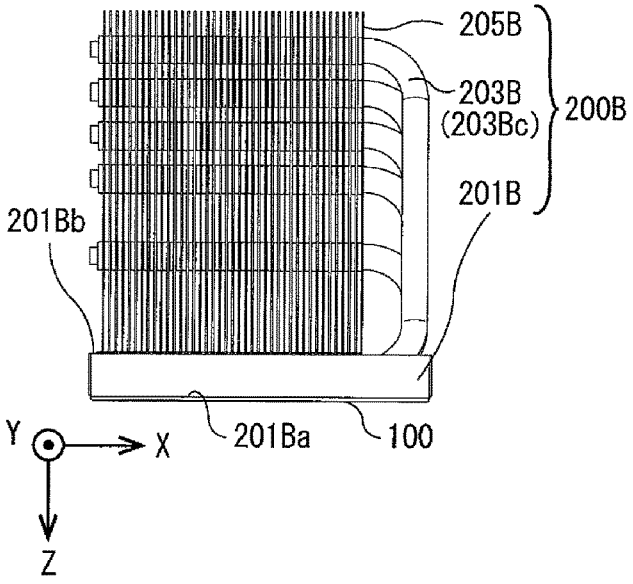
FIGS. 10A, 10B, 10C and 10D are diagrams of outward appearance schematically illustrating the construction of a light illuminating apparatus with a heat radiating apparatus according to a third embodiment of the present disclosure.
Figure 10B:
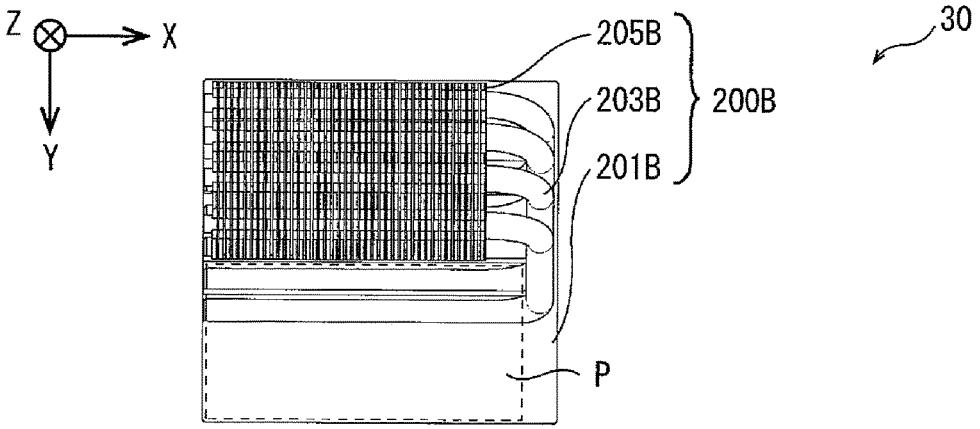
Figure 10C:
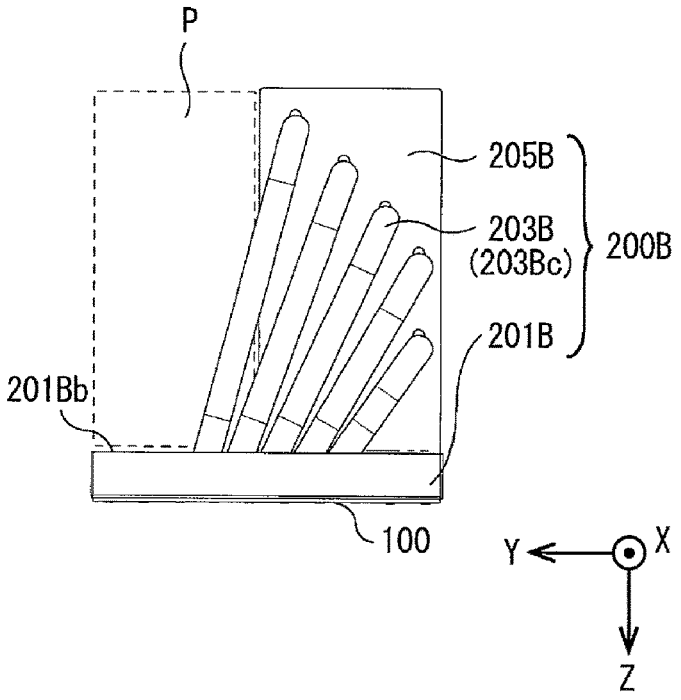
Figure 10D:
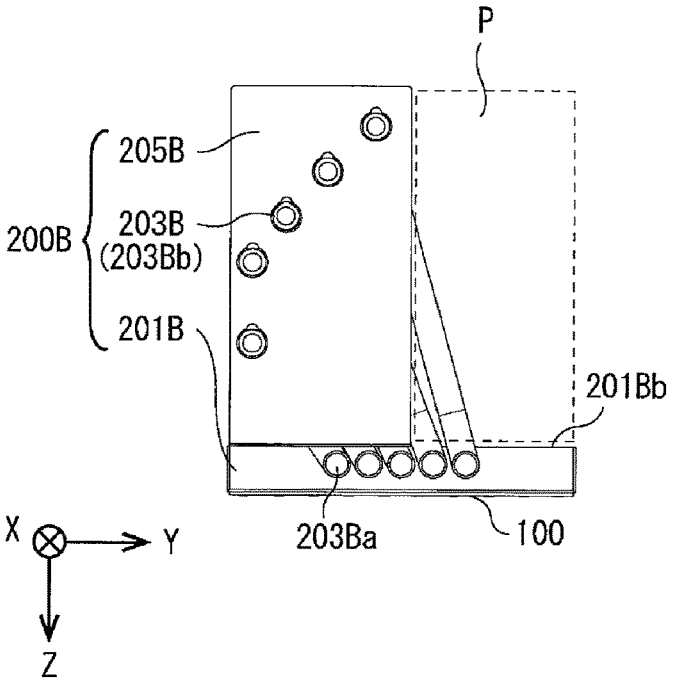

FIG. 9 is a right side view (a diagram when viewed from the X-axis direction downstream side (positive direction side)) of a light illuminating apparatus 20M with a heat radiating apparatus 200AM according to a variation of the heat radiating apparatus 200A of this embodiment. As shown in FIG. 9, the light illuminating apparatus 20M of this variation is different from the light illuminating apparatus 20 of this embodiment in the respect that the heat radiating apparatus 200AM has a cooling fan 210A.

The cooling fan 210A is a device that is placed at the Z-axis direction upstream side (negative direction side) of the heat radiating apparatus 200AM to supply cooling air to the heat radiating apparatus 200AM in the same way as the cooling fan 210 of variation 1. As shown in FIGS. 7 and 9, in this variation, an interval of Y-axis direction of the second line parts 203Ab (not shown in FIG. 9) is wide, and thus, a larger amount of air current W arrives at the second principal surface 201Ab of the support member 201A as compared to variation 1. Accordingly, by the construction of this variation, the cooling capacity of the heat radiating apparatus 200AM can be further improved. Furthermore, the cooling fan 210A can be applied to the construction in which the light illuminating apparatuses 20M are connected as shown in FIG. 8, and in this case, one cooling fan 210A may be formed for each heat radiating apparatus 200AM, and one cooling fan 210A may be formed for the plurality of heat radiating apparatuses 200AM.

Third Embodiment

Figure 11:
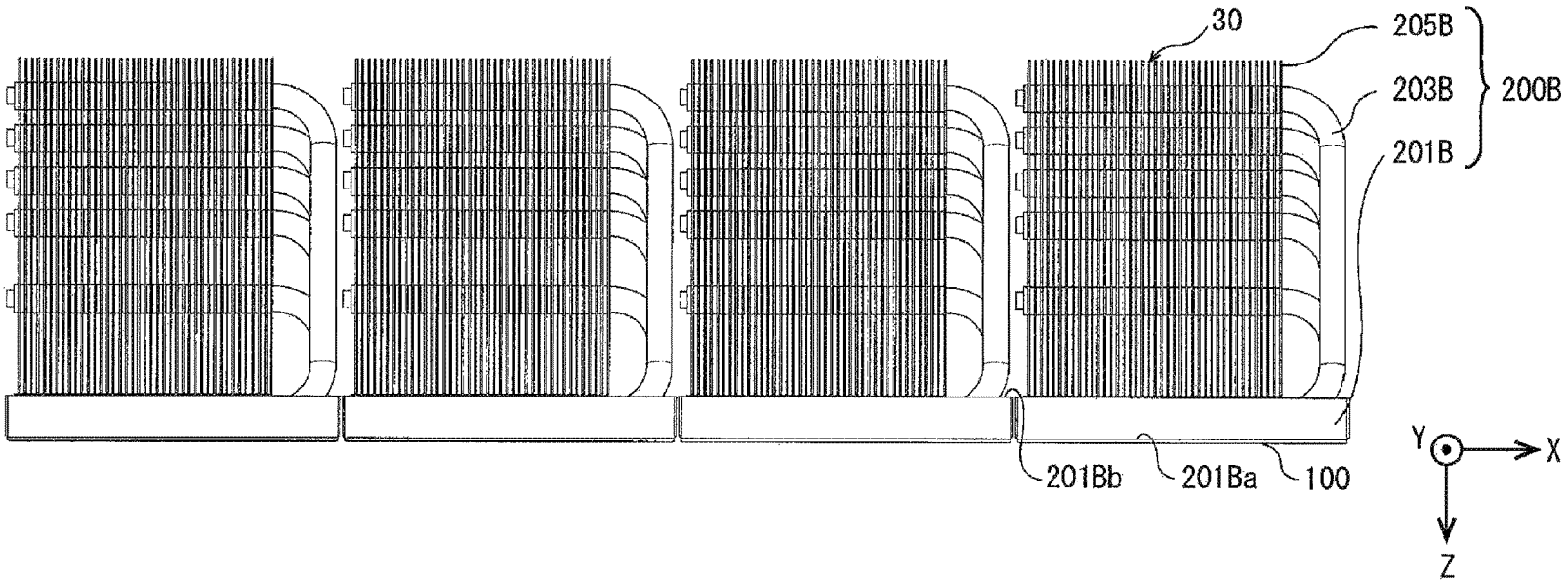
FIG. 11 is a diagram showing that heat radiating apparatuses according to a third embodiment of the present disclosure are connected.

FIG. 10 is a diagram of outward appearance schematically illustrating the construction of a light illuminating apparatus 30 with a heat radiating apparatus 200B according to a third embodiment of the present disclosure. FIG. 10A is a plane view (a diagram when viewed from the Y-axis direction downstream side (positive direction side)) of the light illuminating apparatus 30 of this embodiment, FIG. 10B is a bottom view (a diagram when viewed from the Z-axis direction upstream side (negative direction side)), FIG. 100 is a right side view (a diagram when viewed from the X-axis direction downstream side (positive direction side)), and FIG. 10D is a left side view (a diagram when viewed from the X-axis direction upstream side (negative direction side)). The light illuminating apparatus 30 of this embodiment is different from the heat radiating apparatus 200 of the first embodiment in the respect that the location of second line parts 203Bb of each heat pipe 203B differs in Y-axis direction and Z-axis when viewed in X-axis direction (FIG. 10D), the length of connecting parts 203Bc of each heat pipe 203B differs (FIG. 10A, FIG. 100), and heat radiating fins 205B are formed at the Y-axis direction upstream side (negative direction side) of a second principal surface 201Bb of a support member 201B, and a space P is formed at the Y-axis direction downstream side (positive direction side) of the second principal surface 201Bb of the support member 201B (FIG. 10B, FIG. 100, FIG. 10D). Accordingly, by this construction, other component (for example, a cooling fan and a LED driving circuit) may be placed in the space P. Furthermore, similar to the heat radiating apparatus 200A of the second embodiment, first line parts 203Ba of each heat pipe 203B of this embodiment are arranged approximately parallel to Y-axis direction in the proximity of the center part of the support member 201B when viewed in X-axis direction. Accordingly, the cooling capacity of the center part of the support member 201B can be increased, and thus, it is effective, for example, in the case that the LED devices 110 of the LED unit 100 are intensively arranged at the rough center part of Y-axis direction of the substrate 105. Moreover, because the light illuminating apparatus 30 of this embodiment has the heat pipes 203B and the heat radiating fins 205B configured not to deviate from a space that faces the second principal surface 201Bb of the support member 201B in the same way as the light illuminating apparatus 10 of the first embodiment, it is possible to connect and arrange the light illuminating apparatuses 30 by joining the support members 201B such that first principal surfaces 201Ba of the support members 201B are successive as shown in FIG. 11.

(Variation 3)

Figure 12:
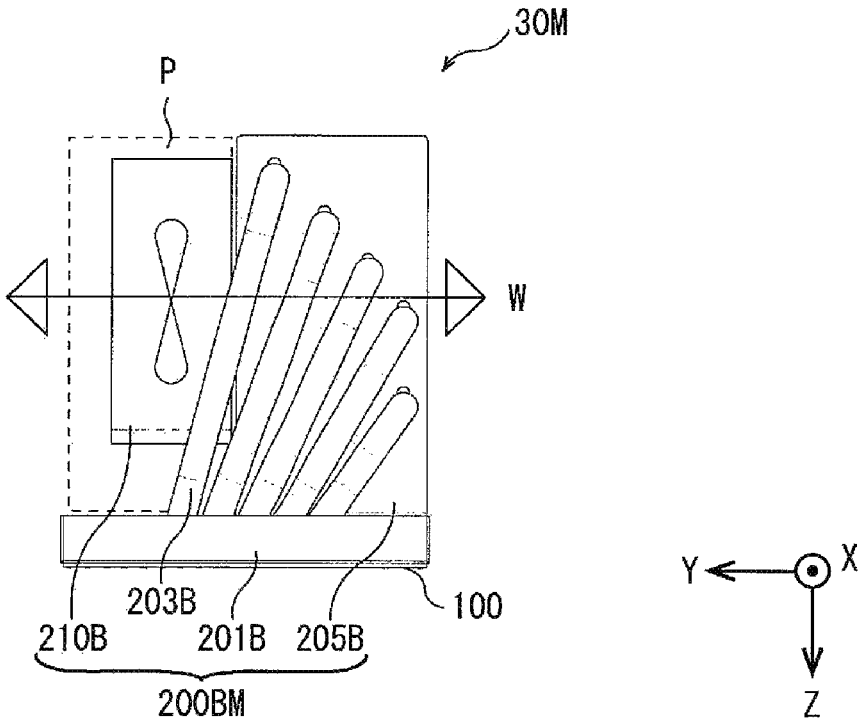
FIG. 12 is a diagram showing the construction of a variation of a heat radiating apparatus according to a third embodiment of the present disclosure.
Figure 13A:
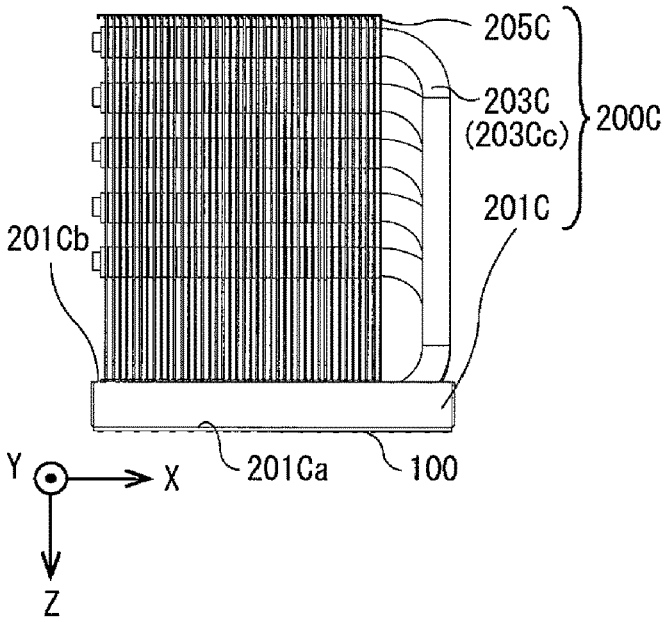
FIGS. 13A, 13B, 13C and 13D are diagrams of outward appearance schematically illustrating the construction of a light illuminating apparatus with a heat radiating apparatus according to a fourth embodiment of the present disclosure.
Figure 13B:
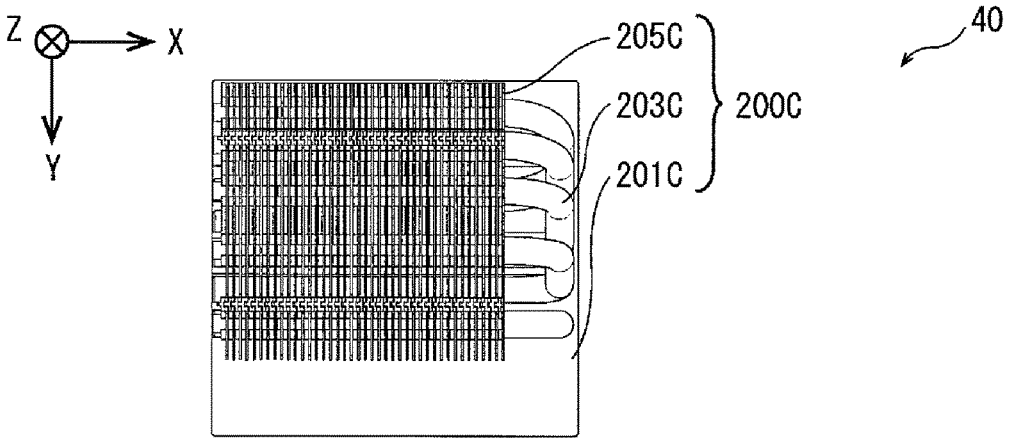
Figure 13C:
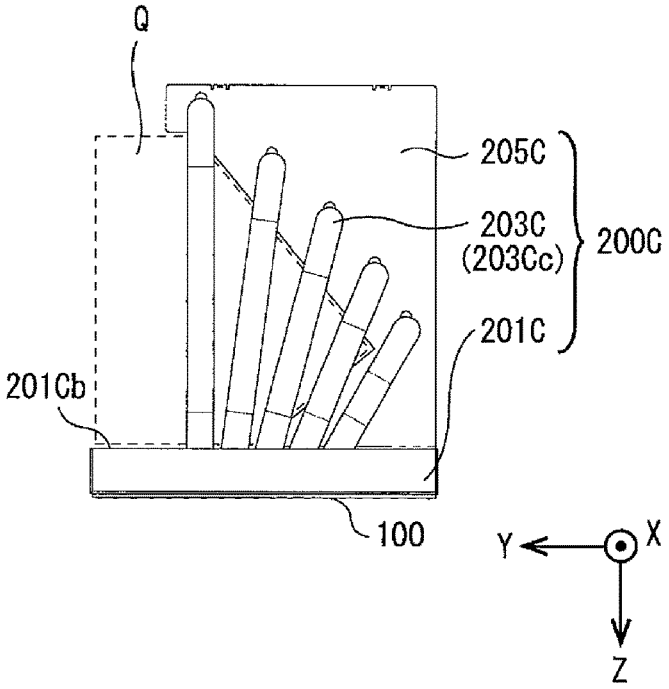
Figure 13D:
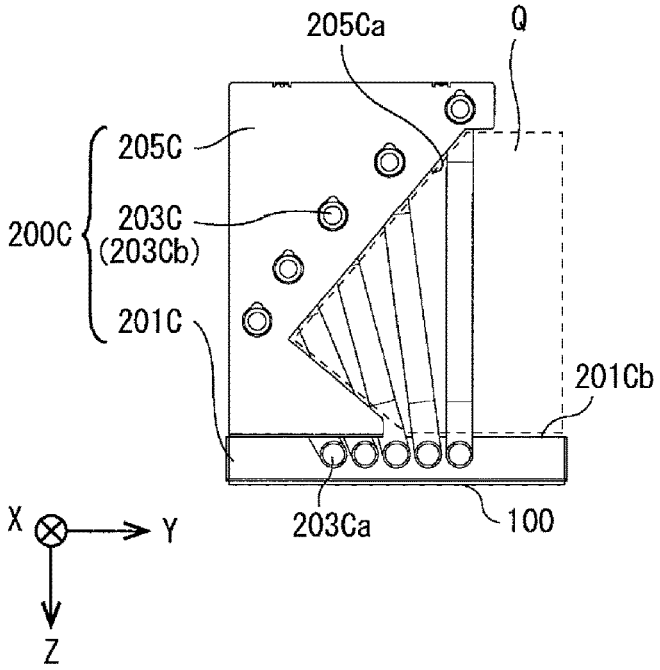

FIG. 12 is a right side view (a diagram when viewed from the X-axis direction downstream side (positive direction side)) of a light illuminating apparatus 30M with a heat radiating apparatus 200BM according to a variation of the heat radiating apparatus 200B of this embodiment. As shown in FIG. 12, the light illuminating apparatus 30M of this variation is different from the light illuminating apparatus 30 of this embodiment in the respect that the heat radiating apparatus 200BM has a cooling fan 210B.

The cooling fan 210B is a device that is placed in the space P on the second principal surface 201Bb of the support member 201B to supply cooling air to the heat radiating apparatus 200BM. As shown in FIG. 12, the cooling fan 210B of this variation generates an air current W in a direction approximately parallel to the second principal surface 201Bb of the support member 201B (i.e., a Y-axis direction or a direction opposite to the Y-axis direction). The air current W generated by the cooling fan 210B flows between each heat radiating fin 205B, and cools each heat radiating fin 205B, as well as the second line parts 203Bb (FIG. 10) of each heat pipe 203B inserted into and passing through each heat radiating fin 205B. In this variation, because the location of the second line parts 203Bb (FIG. 10) of each heat pipe 203B differs in Z-axis direction, the air current W generated by the cooling fan 210B certainly hits each second line part 203Bb (FIG. 10). Accordingly, by the construction of this variation, the cooling capacity of the heat radiating apparatus 200BM can be remarkably improved. Furthermore, the cooling fan 210B can be applied to the construction in which the light illuminating apparatuses 30M are connected as shown in FIG. 11, and in this case, one cooling fan 210B may be formed for each heat radiating apparatus 200BM, and one cooling fan 210B may be formed for the plurality of heat radiating apparatuses 200BM.

Fourth Embodiment

FIG. 13 is a diagram of outward appearance schematically illustrating the construction of a light illuminating apparatus 40 with a heat radiating apparatus 200C according to a fourth embodiment of the present disclosure. FIG. 13A is a plane view (a diagram when viewed from the Y-axis direction downstream side (positive direction side)) of the light illuminating apparatus 40 of this embodiment, FIG. 13B is a bottom view (a diagram when viewed from the Z-axis direction upstream side (negative direction side)), FIG. 13C is a right side view (a diagram when viewed from the X-axis direction downstream side (positive direction side)), and FIG. 13D is a left side view (a diagram when viewed from the X-axis direction upstream side (negative direction side)). The light illuminating apparatus 40 of this embodiment has different locations of second line parts 203Cb of each heat pipe 203C in Y-axis direction and Z-axis direction when viewed in X-axis direction (FIG. 13D). Specifically, the light illuminating apparatus 40 of this embodiment is different from the heat radiating apparatus 200 of the first embodiment in the respect that the location of Z-axis direction (i.e., the height from a second principal surface 201Cb) of the second line part 203Cb of the heat pipe 203C disposed at the Y-axis direction downstream side (positive direction side) is higher than the location of Z-axis direction (i.e., the height from the second principal surface 201Cb) of the second line part 203Cb of the heat pipe 203C disposed at the Y-axis direction upstream side (negative direction side), the length of connecting parts 203*cc* of each heat pipe 203C differs (FIG. 13A, FIG. 13C), a heat radiating fin 205C have a cutout part 205Ca cut at the location lower than each second line part 203Cb, and a space Q surrounded by the cutout part 205Ca, each heat pipe 203C, and the second principal surface 201Cb is formed (FIG. 13C, FIG. 13D). By this construction, other component (for example, a cooling fan and a LED driving circuit may be placed in the space Q.

Figure 14:
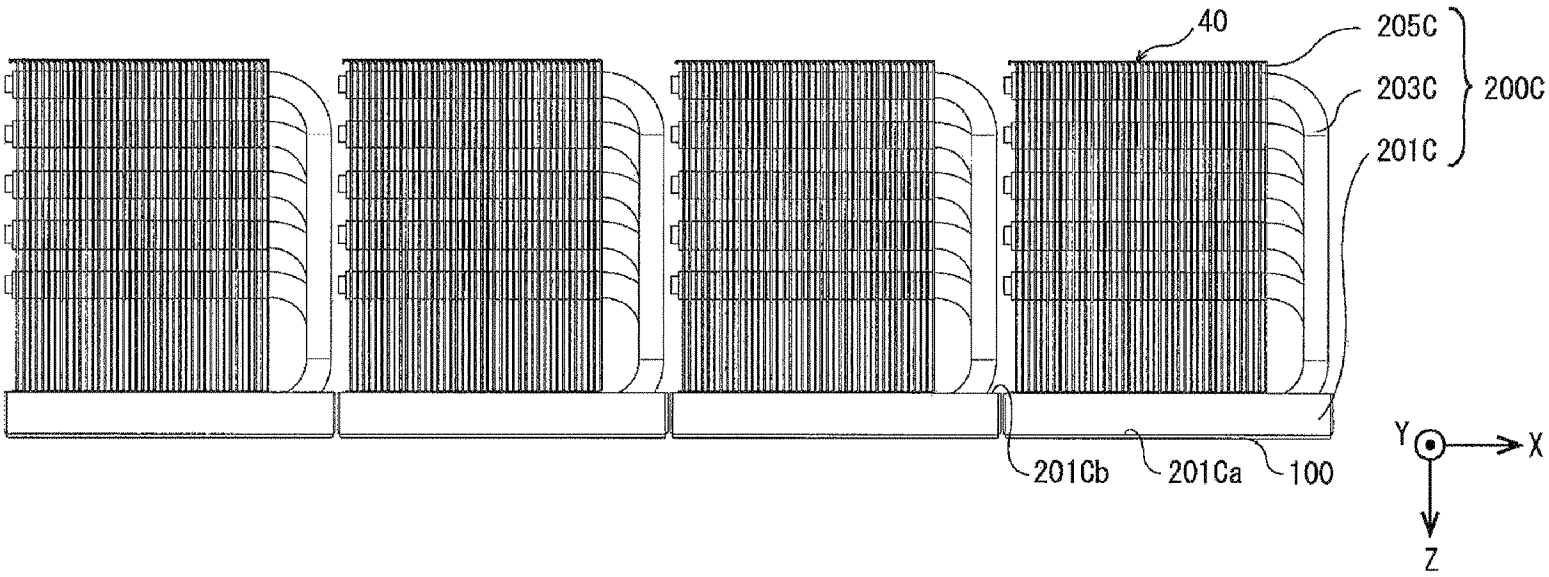
FIG. 14 is a diagram showing that heat radiating apparatuses according to a fourth embodiment of the present disclosure are connected.

Furthermore, similar to the heat radiating apparatus 200A of the second embodiment, first line parts 203Ca of each heat pipe 203C of this embodiment are arranged approximately parallel to Y-axis direction in the proximity of the center part of the support member 201C when viewed in X-axis direction. Accordingly, the cooling capacity of the center part of the support member 201C can be increased, and thus, it is effective, for example, in the case that the LED devices 110 of the LED unit 100 are intensively arranged at the rough center part of Y-axis direction of the substrate 105. Moreover, because the light illuminating apparatus 40 of this embodiment has the heat pipes 203C and the heat radiating fins 205C configured not to deviate from a space that faces the second principal surface 201Cb of the support member 201C in the same way as the light illuminating apparatus 10 of the first embodiment, it is possible to connect and arrange the light illuminating apparatuses 40 by joining the support members 201C such that first principal surfaces 201Ca of the support members 201C are successive as shown in FIG. 14.

(Variation 4)

Figure 15:
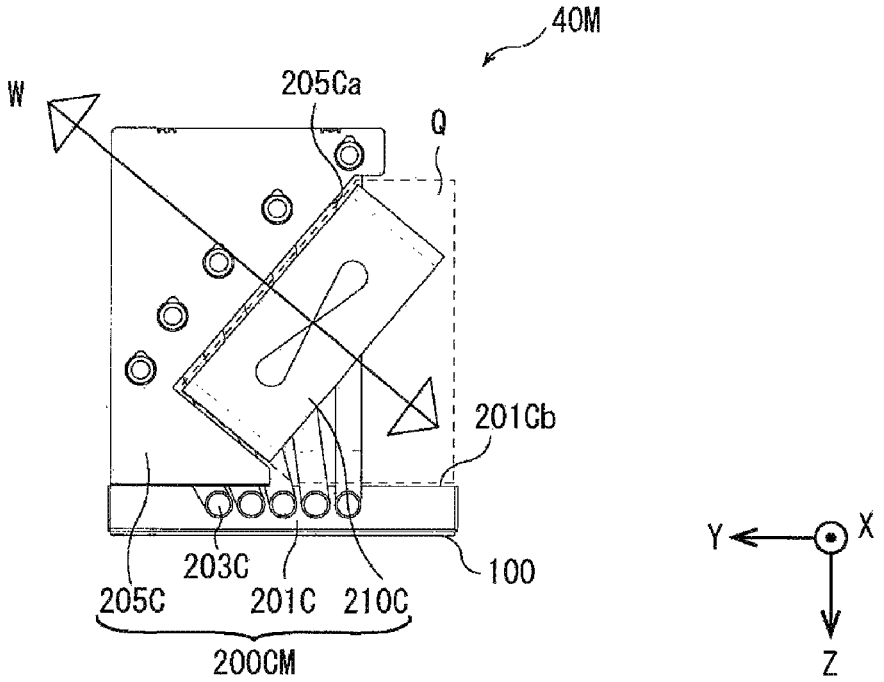
FIG. 15 is a diagram showing the construction of a variation of a heat radiating apparatus according to a fourth embodiment of the present disclosure.

FIG. 15 is a left side view (a diagram when viewed from the X-axis direction upstream side (negative direction side)) of a light illuminating apparatus 40M with a heat radiating apparatus 200CM according to a variation of the heat radiating apparatus 200C of this embodiment. As shown in FIG. 15, the light illuminating apparatus 40M of this variation is different from the light illuminating apparatus 40 of this embodiment in the respect that the heat radiating apparatus 200CM has a cooling fan 210C.

The cooling fan 210C is a device that is placed in the space Q surrounded by the cutout part 205Ca, each heat pipe 203C, and the second principal surface 201Cb to supply cooling air to the heat radiating apparatus 200CM. As shown in FIG. 15, the cooling fan 210C of this variation is placed facing the cutout part 205Ca to generate an air current W in a direction inclined with respect to Y-axis direction and Z-axis direction. The air current W generated by the cooling fan 210C flows between each heat radiating fin 205C, and cools each heat radiating fin 205C, as well as the second line parts 203Cb of each heat pipe 203C inserted into and passing through each heat radiating fin 205C. In this variation, because the second line parts 203Cb of each heat pipe 203C are arranged to conform to the cutout parts 205Ca (i.e., facing the cooling fan 210C), the air current W generated by the cooling fan 210C certainly hits each second line part 203Cb. Accordingly, by the construction of this variation, the cooling capacity of the heat radiating apparatus 200CM can be remarkably improved. Furthermore, the cooling fan 210C can be applied to the construction in which the light illuminating apparatuses 40M are connected as shown in FIG. 14, and in this case, one cooling fan 210C may be formed for each heat radiating apparatus 200CM, and one cooling fan 210C may be formed for the plurality of heat radiating apparatuses 200CM.

Furthermore, it should be understood that the disclosed experiments are illustrative in all aspects and are not limitative. The scope of the present disclosure is defined by the appended claims rather than the foregoing description, and encompasses all changes within the meaning and scope of equivalents to the claims.

The invention claimed is:

1. A heat radiating apparatus that is placed in close contact with a heat source to radiate heat of the heat source in air, the heat radiating apparatus comprising:

a support member which has a shape of a plate with a first principal surface and a second principal surface, and is placed in close contact with the heat source on the first principal surface;

a heat pipe which is supported by the support member, and is thermally joined with the support member to transfer the heat from the heat source; and a plurality of heat radiating fins which is placed in a space that faces the second principal surface opposite to the first principal surface, and is thermally joined with the heat pipe to radiate the heat transferred by the heat pipe, wherein the heat pipe comprises:

a first line part which is thermally joined with the support member;

a second line part which is thermally joined with the plurality of heat radiating fins; and a connecting part which connects one end part of the first line part to one end part of the second line part such that the first line part and the second line part are successive, wherein a length of the heat pipe in a direction in which the first line part extends is slightly shorter than or equal to a length of the support member in the direction in which the first line part extends, wherein the connecting part has a curved part that is thermally joined with the support member in the proximity of one end part of the first line part, and wherein a plurality of heat radiating apparatuses are arranged in the direction in which the plurality of heat radiating fins are arranged in parallel, and the plurality of heat radiating apparatuses are connected such that the first principal surfaces of the support members of the plurality of heat radiating apparatuses are successive.

2. The heat radiating apparatus according to claim 1, wherein the heat pipe is provided in multiple numbers, and the first line parts of the plurality of heat pipes are placed at a first predetermined interval in a direction approximately orthogonal to a direction in which the first line parts extend.

3. The heat radiating apparatus according to claim 2, wherein the second line parts of the plurality of heat pipes are approximately parallel to the second principal surface, and are placed at the first predetermined interval in a direction approximately orthogonal to the direction in which the first line parts extend.

4. The heat radiating apparatus according to claim 2, wherein the second line parts of the plurality of heat pipes are approximately parallel to the second principal surface, and are placed at a second predetermined interval that is longer than the first predetermined interval in a direction approximately orthogonal to the direction in which the first line parts extend.

5. The heat radiating apparatus according to claim 1, wherein comprises a fan which is placed in the space that faces the second principal surface to generate an air current in a direction approximately perpendicular to the second principal surface.

6. The heat radiating apparatus according to claim 2, wherein locations of the second line parts of each heat pipe differ in a direction approximately perpendicular to and a direction approximately parallel to the second principal surface, when viewed in the direction in which the first line part extends.

7. The heat radiating apparatus according to claim 6, wherein comprises a fan which is placed in the space that faces the second principal surface to generate an air current in a direction approximately parallel to the second principal surface.

8. The heat radiating apparatus according to claim 6, wherein the plurality of heat radiating fins has a cutout part in a space surrounded by the first line parts and the second line parts of the plurality of heat pipes, and a fan is provided in a space formed by the cutout part to generate an air current in a direction inclined with respect to the second principal surface.

9. The heat radiating apparatus according to claim 1, wherein the second line part is approximately parallel to the second principal surface.

10. The heat radiating apparatus according to claim 1, wherein the support member has a groove part in a shape that conforms to the first line part and the curved part on the second principal surface side, and is placed such that the first line part and the curved part are inserted and put into the groove part.

11. A light illuminating apparatus comprising:

the heat radiating apparatus defined in claim 1;

a substrate placed in close contact with the first principal surface; and a plurality of light emitting diode (LED) devices placed approximately parallel to the first line part of the heat pipe on a surface of the substrate.

12. The light illuminating apparatus according to claim 11, wherein the plurality of LED devices is placed at a predetermined pitch in a direction in which the first line part extends, and a distance from the first line part to one end of the support member and a distance from the connecting part to the other end of the support member in the direction in which the first line part extends are ½ or less of the pitch.

13. The light illuminating apparatus according to claim 11, wherein the plurality of LED devices is placed in multiple rows in a direction approximately orthogonal to the direction in which the first line part extends.

14. The light illuminating apparatus according to claim 11, wherein the plurality of LED devices is placed at a location opposite to the first line part with the substrate interposed between.

15. The light illuminating apparatus according to claim 11, wherein the light illuminating apparatus comprises the plurality of heat radiating apparatuses connected such that the first principal surfaces are successive.

16. The light illuminating apparatus according to claim 15, wherein the plurality of heat radiating apparatuses is arranged and connected in the direction in which the first line part extends.

17. The light illuminating apparatus according to claim 11, wherein the LED device emits light of a wavelength that acts on an ultraviolet curable resin.

18. The heat radiating apparatus according to claim 2, wherein comprises a fan which is placed in the space that faces the second principal surface to generate an air current in a direction approximately perpendicular to the second principal surface.

19. The heat radiating apparatus according to claim 3, wherein comprises a fan which is placed in the space that faces the second principal surface to generate an air current in a direction approximately perpendicular to the second principal surface.

20. The heat radiating apparatus according to claim 4, wherein comprises a fan which is placed in the space that faces the second principal surface to generate an air current in a direction approximately perpendicular to the second principal surface.

* * * * *